US011420133B2

(12) United States Patent
Loik

(10) Patent No.: US 11,420,133 B2
(45) Date of Patent: Aug. 23, 2022

(54) MOLDABLE MATERIAL TOY BUILDER

(71) Applicants: Hasbro, Inc., Pawtucket, RI (US); Happy Dragon Studio, LLC, Johnston, RI (US)

(72) Inventor: Jason Loik, Johnston, RI (US)

(73) Assignee: Happy Dragon Studio, LLC, Johnston, RI (US)

( * ) Notice: Subject to any disclaimer, the term of this patent is extended or adjusted under 35 U.S.C. 154(b) by 0 days.

(21) Appl. No.: 16/875,090

(22) Filed: May 15, 2020

(65) Prior Publication Data

US 2020/0368632 A1 Nov. 26, 2020

Related U.S. Application Data

(60) Provisional application No. 62/851,592, filed on May 22, 2019.

(51) Int. Cl.
*A63H 33/00* (2006.01)
*A63H 33/32* (2006.01)

(52) U.S. Cl.
CPC ..... *A63H 33/001* (2013.01); *A63H 33/32* (2013.01)

(58) Field of Classification Search
CPC ..... A63H 33/001; A63H 33/32
See application file for complete search history.

(56) References Cited

U.S. PATENT DOCUMENTS 746,961 A 12/1903 Marchiony
1,458,508 A 6/1923 Aiken
1,606,778 A * 11/1926 Yancey ..... A47J 37/0611 99/383
1,610,121 A * 12/1926 Dickinson ..... A63H 33/001 425/DIG. 57
1,886,486 A * 11/1932 Le Ganger ..... A63H 33/001 249/104
1,906,882 A 5/1933 Perret
1,947,124 A * 2/1934 Clauss ..... A47J 37/0611 425/188
2,831,286 A 4/1958 Eisner
2,939,299 A 6/1960 Sherbloom
3,054,711 A 9/1962 Powell
3,061,880 A 11/1962 Weisbach
(Continued)

FOREIGN PATENT DOCUMENTS

CN 108437505 A * 8/2018
KR 20-0408514 Y1 2/2006
KR 10-2014-0144649 A 12/2014

OTHER PUBLICATIONS

Derwent abstract and Figure for CN108437505A (Year: 2018).*
(Continued)

*Primary Examiner* — Eugene L Kim
*Assistant Examiner* — Alyssa M Hylinski
(74) *Attorney, Agent, or Firm* — DiBerardino McGovern IP Group LLC

(57) ABSTRACT

A toy set includes: a first mold portion including: a first base portion, and
an indentation formation portion extending from the first base portion, the indentation formation portion including an edge. The first mold portion is configured to receive a moldable material, the indentation formation portion is configured to form an indentation in a first side of the moldable material, and the indentation allows the moldable material to fold without separating.

40 Claims, 21 Drawing Sheets

(56) References Cited

U.S. PATENT DOCUMENTS 3,222,437 A * 12/1965 Schilling ..... B29C 44/56 16/385
3,474,498 A * 10/1969 Hoppes ..... B29C 49/52 249/141
3,552,711 A 1/1971 DeLaney et al.
3,574,968 A * 4/1971 Schlau ..... A63H 9/00 425/DIG. 57
3,598,358 A * 8/1971 Clearwaters ..... A63H 33/001 249/117
3,670,449 A * 6/1972 Lemkin ..... A63H 33/088 446/102
3,741,706 A * 6/1973 Conley ..... B29C 43/00 425/408
3,788,590 A 1/1974 Hasselbach
3,861,640 A 1/1975 Agneta
3,891,179 A 6/1975 Berman
3,892,510 A 7/1975 Meth et al.
3,907,245 A 9/1975 Linder
3,921,801 A 11/1975 Sway
3,940,142 A 2/1976 Hinz et al.
3,966,166 A 6/1976 Elliott
3,989,220 A 11/1976 Greenberg
4,073,610 A * 2/1978 Cox ..... B29C 45/5675 425/577
4,215,843 A 8/1980 Gay et al.
4,321,291 A 3/1982 Brownell
4,431,395 A * 2/1984 Babos ..... A21C 11/106 249/161
4,543,229 A * 9/1985 Nickerson ..... E04C 1/41 264/46.7
4,569,815 A * 2/1986 Rentz ..... A63H 33/001 425/DIG. 57
4,988,321 A 1/1991 Goldfarb
5,088,598 A 2/1992 Iguchi
D345,898 S 4/1994 Aiken et al.
D350,461 S 9/1994 Christopher et al.
5,413,472 A * 5/1995 Dietterich ..... B29C 33/303 425/188
5,427,528 A 6/1995 Anderson et al.
D381,245 S 7/1997 Eisbrenner et al.
5,788,873 A 8/1998 Warsaw
5,954,561 A 9/1999 Cannone
D420,866 S 2/2000 VanHalteren et al.
6,579,144 B1 6/2003 Chang
D538,465 S 3/2007 Lin
D543,073 S 5/2007 Rich
7,275,924 B1 * 10/2007 Kreuzer ..... B29C 48/02 425/170
8,109,757 B1 2/2012 Fusi, III
8,192,776 B2 6/2012 Vardy et al.
D698,196 S * 1/2014 Barber ..... D7/354
9,687,752 B2 6/2017 Clark et al.
9,820,609 B2 * 11/2017 Fast ..... A47J 37/0611
9,874,474 B2 1/2018 Cho et al.
10,792,558 B1 10/2020 Goldstein
2001/0041196 A1 * 11/2001 Yamane ..... A63H 33/001 425/129.1
2003/0094754 A1 * 5/2003 Dewa ..... A63F 9/0413 273/146
2004/0020370 A1 * 2/2004 Jackson ..... A47J 37/0611 99/331
2006/0017198 A1 1/2006 Koehl
2006/0154214 A1 * 7/2006 Miller ..... B28B 11/0809 434/82
2008/0061471 A1 * 3/2008 Bradley ..... A63H 33/044 264/279
2016/0354682 A1 12/2016 Edwards
2017/0314901 A1 11/2017 Howarth
2019/0054369 A1 2/2019 Edwards
2019/0255452 A1 * 8/2019 Henry ..... B29C 39/36
2020/0230512 A1 7/2020 Lemoine et al.

OTHER PUBLICATIONS

Hasbro, Inc. "Play-Doh Cranky the Octopus,", available at https://playdoh.hasbro.com/en-ca/product/play-doh-cranky-the-octopus:1894BD23-C743-4CCF-9BD3-86F01022FD1C (Jan. 16, 2019).
Bahng Seung Hoon, Korean Intellectual Property Office, International Search Report and Written Opinion, corresponding PCT Application No. PCT/US2020/033093, dated Sep. 3, 2020, 13 pages total.

* cited by examiner

MOLDABLE MATERIAL TOY BUILDER

CROSS-REFERENCE TO RELATED APPLICATION

This application claims the benefit of U.S. Provisional Application No. 62/851,592, filed on May 22, 2019 and titled MOLDABLE MATERIAL TOY BUILDER, which is incorporated herein by reference in its entirety.

TECHNICAL FIELD

This disclosure relates to a moldable material toy builder.

BACKGROUND

Persons of all ages enjoy playing and interacting with toys.

SUMMARY

In one aspect, a toy set includes: a first mold portion including: a first base portion, and an indentation formation portion extending from the first base portion, the indentation formation portion including an edge. The first mold portion is configured to receive a moldable material, the indentation formation portion is configured to form an indentation in a first side of the moldable material, and the indentation allows the moldable material to fold without separating.

Implementations may include one or more of the following features. The indentation formation portion may be arranged to form a plurality of design regions. The first base portion may define an opening in each of the design regions. Each opening may be shaped as indicator that corresponds to a step of a sequence of instructions for forming a toy from the moldable material. The toy set also may include data representing the sequence of instructions. The data representing the sequence of instructions may include one or more of a physical object containing the sequence of instructions or a location of the sequence of instructions. Each indicator may include a number, and all of the numbers in the first base portion may be different. The toy set also may include a pressing device configured to apply pressure to the first side of the moldable material through any one of the openings.

In some implementations, the toy set also includes a second mold portion. The second mold portion may include: a second base portion, and at least one design projection extending from the second base portion. The first mold portion may include a plurality of openings, the design projection may be formed on a first side of the second base portion, tabs may extend from a second side of the second base portion, and each tab may be configured to fit into one of the plurality of openings in the first base portion. The first mold portion and the second mold portion may be permanently connected to each other by a connection mechanism. The connection mechanism may be configured to allow the first mold portion and the second mold portion to rotate relative to each other. The connection mechanism may include a hinge. The first base portion of the first mold portion may include a first perimeter having a first shape, the second base portion of the second mold portion may include a second perimeter having a second shape, and the first and second shapes are substantially the same. The perimeter of the first mold portion may fit within the perimeter of the second mold portion or the perimeter of the second mold portion may fits within the perimeter of the first mold portion.

In some implementations, the toy set also includes the moldable material. The toy set also may include a canister configured to hold the moldable material.

The toy set also may include a support structure configured to hold the moldable material after the indentation is formed.

The indentation formation portion may include a tapered edge.

The first mold portion may include a plurality of indentation formation portions, and at least one of the plurality of indentation formation portions may include one or more spatial properties that are different from the same one or more spatial properties of at least one other of the plurality indentation formation portions.

The first mold portion may further include a design projection extending from the first side of the first base portion. The design projection may be configured to form an imprint in the first side of the moldable material. The moldable material may be configured to fold at the indentation portion such that the imprint is on an exterior of a toy made using the moldable material.

In another aspect, a method of forming a toy from a moldable material includes: placing the moldable material into a first mold portion, the first mold portion including an indentation formation portion; pressing the moldable material into the first mold portion and the indentation formation portion to thereby form an indentation in a first side of the moldable material; removing the moldable material from the first mold portion; and forming the toy by folding the moldable material at the indentation.

Implementations may include one or more of the following features. Removing the moldable material from the first mold portion may include pressing the first side of the moldable material through one or more openings in the first mold portion. Pressing the moldable material into the first mold portion and the indentation formation portion may include flattening the moldable material into the first mold portion. The first mold portion may include an opening defined in a first base portion, the opening extends along a direction that is orthogonal to a direction in which the indentation formation portion extends, and pressing the moldable material into the indentation formation portion farther may form an outline of the opening on the first side of the moldable material. The first mold portion may include a plurality of openings, and pressing the moldable material into the first mold may form an outline of each of the openings on the first side of the moldable material. Each of the openings may have a different shape and may correspond to a step in a sequence of instructions, and forming the toy by folding the moldable material at the indentation may include folding the moldable material based on the shape of the outline and the corresponding step in the sequence of instructions.

In some implementations, the method also includes: pressing a second mold portion including at least one design projection into a second side of the moldable material to thereby imprint the at least one design projection onto the second side of the moldable material; and separating the second mold portion from the second side of the moldable material. Separating the second mold portion from the second side of the moldable material may include pulling the second mold portion away from the second side of the moldable material. Pressing the second mold portion into the second side of the moldable material may include rotating the second mold portion about a connection point that connects the first mold portion and the second mold portion until the at least one design projection is pressed into the second side of the flattened moldable material in the first mold portion. Removing the moldable material from the first mold portion may include rotating the second mold portion about the connection point until tabs on the second mold portion press on the first side of the flattened moldable material though one or more openings in the first mold portion.

Forming the toy by folding the moldable material at the indentation may include folding the moldable material over a support structure.

Forming the toy by folding the moldable material at the indentation may include folding the moldable material into an object that has an open region. The open region may be enclosed by the moldable material such that the object is hollow.

Pressing the moldable material into the first mold portion may form more than one indentation in the first side of the moldable material; and forming the toy by folding the moldable material may include folding the moldable material at more than one indentation to thereby form a hollow object. Forming the toy by folding the moldable material at the indentation may include folding the moldable material into a hollow object that has an open region surrounded by moldable material and the imprint of the one or more design projections faces away from the open region.

In another aspect, a toy set includes: a first mold portion including: a first base portion, and a plurality of formation portion extending from the first base portion, each of the plurality of indentation formation portions including an edge; and a second mold portion including: a second base portion, and at least one design projection extending from the second base portion. The first mold portion is configured to receive a moldable material, each of the plurality of tapered edges is configured to form an indentation in a first side of the moldable material, each of the plurality of indentations is configured to allow the moldable material to fold without separating, and each of the at least one design projections is configured to form an imprint in a second side of the moldable material while the moldable material is received in the first mold portion.

Implementations of any of the techniques described above may include a toy set, a first mold portion, a second mold portion, and first and second mold portion, and/or a method of forming a toy from a moldable material. The details of one or more implementations are set forth in the accompanying drawings and the description below. Other features will be apparent from the description and drawings, and from the claims.

DRAWING DESCRIPTION

DESCRIPTION

Figure 1B:
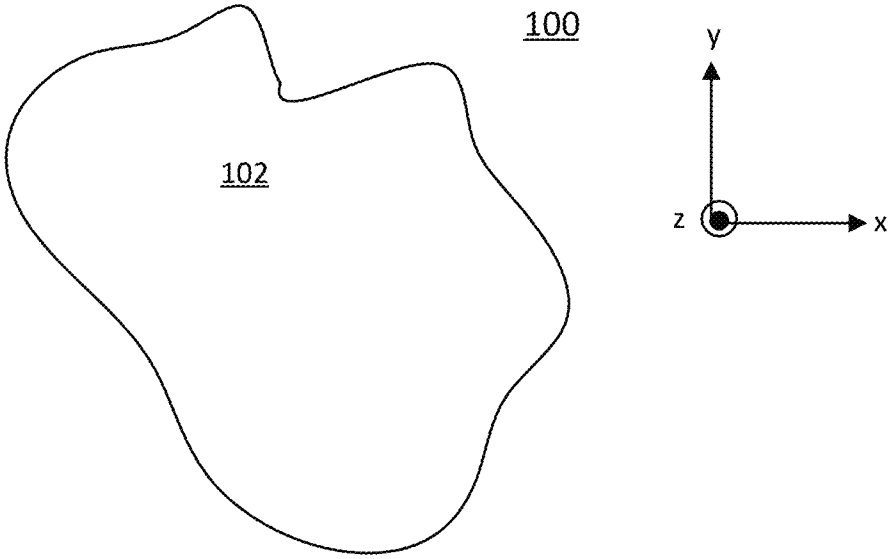
FIG. 1B is an illustration of an example of a moldable material.
Figure 1A:
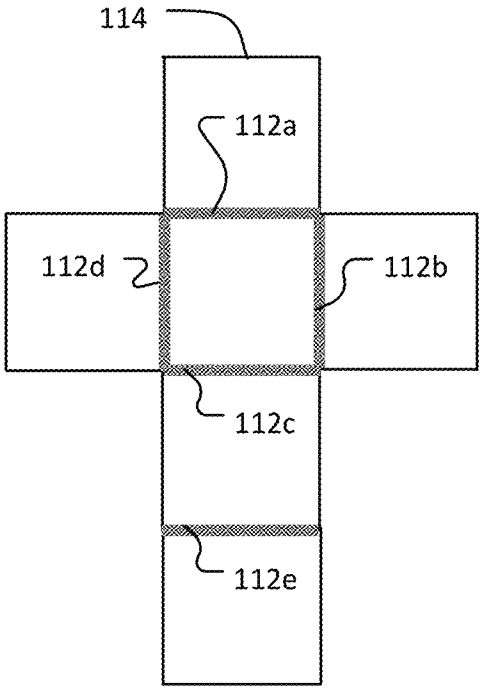
FIG. 1A is a block diagram of an example of a first mold portion.
Figure 1D:
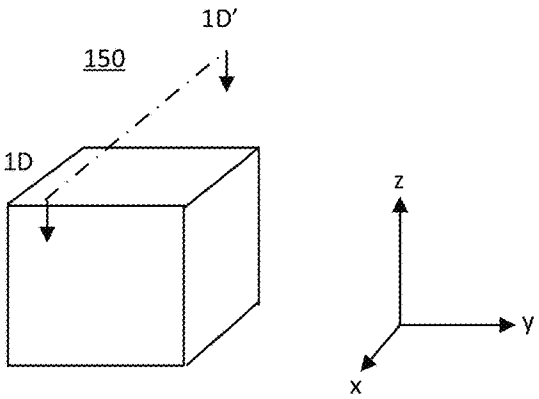
FIG. 1D is a perspective view of an example of a three-dimensional object.
Figure 1C:
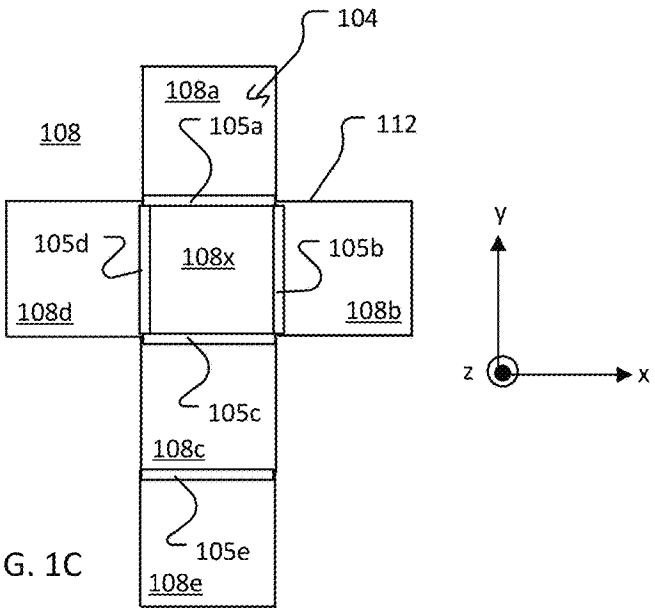
FIG. 1C is an example of a segment of the moldable material.
Figure 1F:
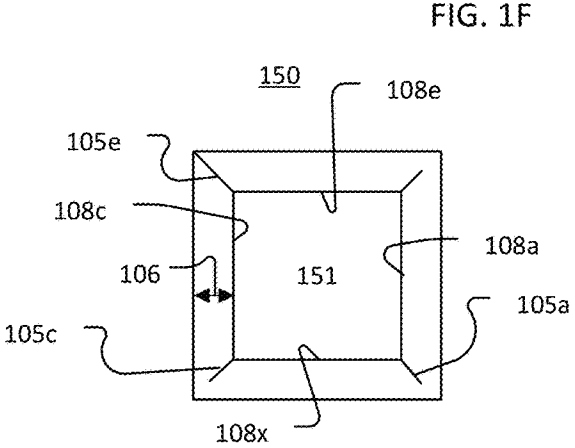
FIG. 1F is a cross-sectional view of the three-dimensional object of FIG. 1D.

FIGS. 1A-1E relate to a toy set 100. The toy set 100 includes a moldable material 102 (FIG. 1B) and a first mold portion 110 (FIG. 1A). The first mold portion 110 is configured to prepare a segment 108 (FIGS. 1C and 1E) for folding into a three-dimensional object 150 (FIGS. 1D and 1F).

The moldable material 102 may be, for example, putty, clay, and/or a dough substance (for example, PLAY-DOH®, available from Hasbro, Inc. of Pawtucket, R.I.). The moldable material 102 may be stored in a canister or other container that may be included with the toy set 100. The first mold portion 110 includes indentation formation portions 112*a*-112*e* (collectively referred to as an indentation formation portion 112) and a cutting portion 114 that surrounds the indentation formation portion 112 in the x-y plane. In the example of FIG. 1A, the indentation formation portion 112 is shown with gray shading, and the cutting portion 114 is shown with a solid line.

Figure 1E:
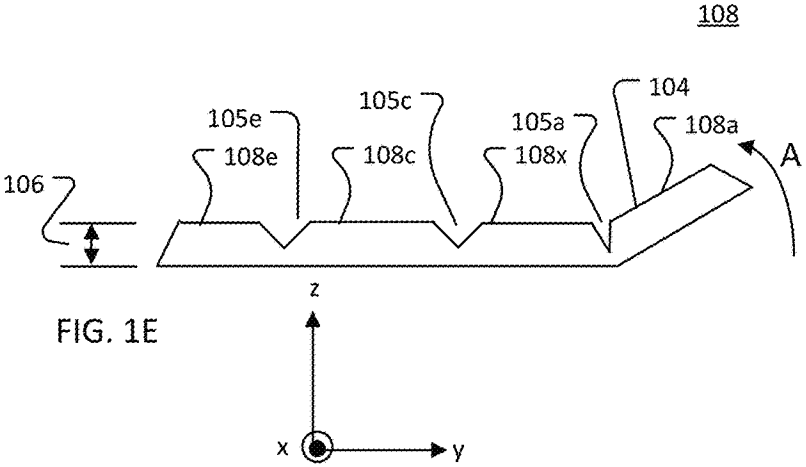
FIG. 1E is a cross-sectional view of the segment of FIG. 1C.

To form the segment 108, the user presses the moldable material 102 into the first mold portion 110. The cutting portion 114 passes through the moldable material 102 to form the segment 108 of the moldable material 102. FIGS. 1C and 1E show a segment 108 of the moldable material 102 after the segment 108 has been removed from the first mold portion 110. The segment 108 is a single continuous piece of the moldable material 102. The segment 108 has an extent or thickness 106 (FIG. 1E) that depends on the extent of the cutting portion 112 in the z direction.

The interaction between the indentation formation portions 112*a*-112*e* and the moldable material 102 forms respective indentations 105*a*-105*e* on a side 104 of the segment 108. The indentations 105*a*-105*e* divide the segment 108 into a plurality of sub-segments 108*a*-108*e*. The indentations 105*a*-105*e* do not pass through the moldable material 102 and the moldable material 102 is able to fold about the indentations 105*a*-105*e* without separating. Because the moldable material 102 is able to fold about the indentations 105*a*-105*e*, the first mold portion 110 allows a user to form a three-dimensional toy 150 (FIG. 1D) from the moldable material 102. In the example of FIG. 1D, the toy 150 is a cube-shaped object or cube. The relative arrangement of the indentation formation portions 112*a*-112*e* and the corresponding relative arrangement of the respective indentations 105*a*-105*e* allows the segment 108 to be folded into the cube-shaped object 150.

FIG. 1E is a side cross-sectional view of the segment 108 in the y-z plane. FIG. 1E shows the sub-segment 108*a* partially folded at the indentation 105*a*. In the example shown, the indentations 105*a*-105*e* are triangularly shaped, with the base of the triangle at the side 104. The extent of the triangle in the z direction is less than the extent 106. To fold the segment 108 into the toy 150, sub-segments 108*a*-108*e* are folded at respective indentations 105*a*-105*e*. For example, the sub-segment 108*a* is rotated along an arc A toward the sub-segment 108*x* until the sub-segment 108*a* makes physical contact with the sub-segment 108*x* at the indentation 105*a*. The sub-segments 108*b*-108*e* are folded in a similar manner. The spatial characteristics of the indentations 105*a*-105*e* (which depend on the spatial characteristics of the indentation formation portions 112*a*-112*e*) determine the angle at which the various sub-segments 108*a*-108*e* and 108*x* are held relative to each other after folding. For example, the indentation formation portions 105*a*-105*e* are right triangles, which results in the various sub-segments 108*a*-108*e* and 108*x* being perpendicular to adjoining sub-segments after folding.

FIG. 1F is a cross-sectional view of the toy 150 taken along the line 1D-1D' of FIG. 1D. The toy 150 includes an interior 151 that is surrounded by the sub-segments 108*a*-108*e* and 108*x*. Thus, the toy 150 is hollow. In some implementations, the toy 150 does not include the interior 151 and is solid instead of hollow. For example, the toy 150 may be solid in implementations in which the thickness 106 is sized such that all of the various sub-sections are in contact with at least some of the other sub-sections and there is no interior 151. Moreover, the toy 150 is shown as a closed object that encloses the interior 151. However, in other implementations, the toy 150 has at least one side that is open. In other words, the interior 151 may be a recess instead of an enclosed space.

Other implementations are possible. For example, the indentation formation portions 112*a*-112*e* may form respective indentations 105*a*-105*e* that are non-right triangles, rectangles, polygonal, or curves. In these implementations, the sub-segments 108*a*-108*e* and 108*x* are not necessarily held perpendicular to adjoining sub-segments after being folded. Moreover, in other implementations, the indentation formation portions 112*a*-112*e* are not identical to each other.

Figure 2A:
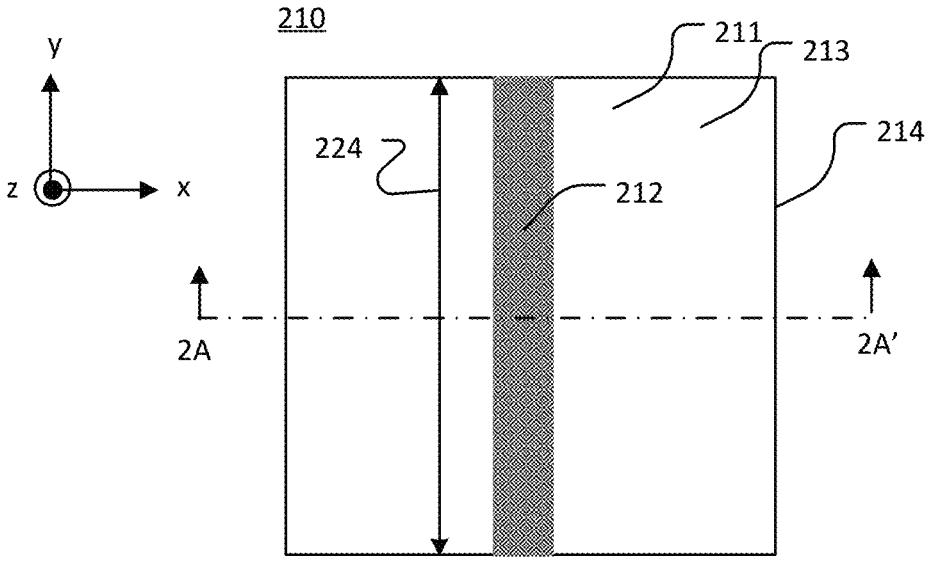
FIG. 2A is a block diagram of another example of a first mold portion.
Figure 2B:
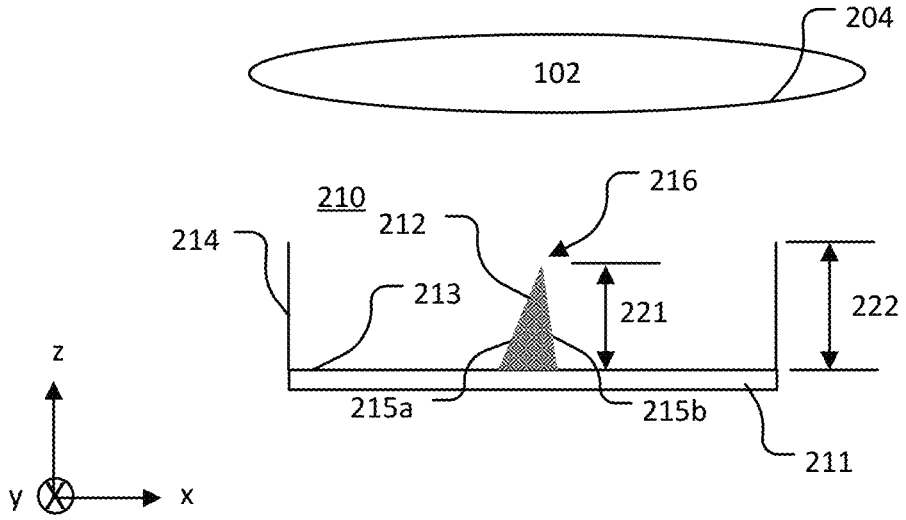
FIG. 2B is a cross-sectional view of the first mold portion of FIG. 2A.
Figure 2C:
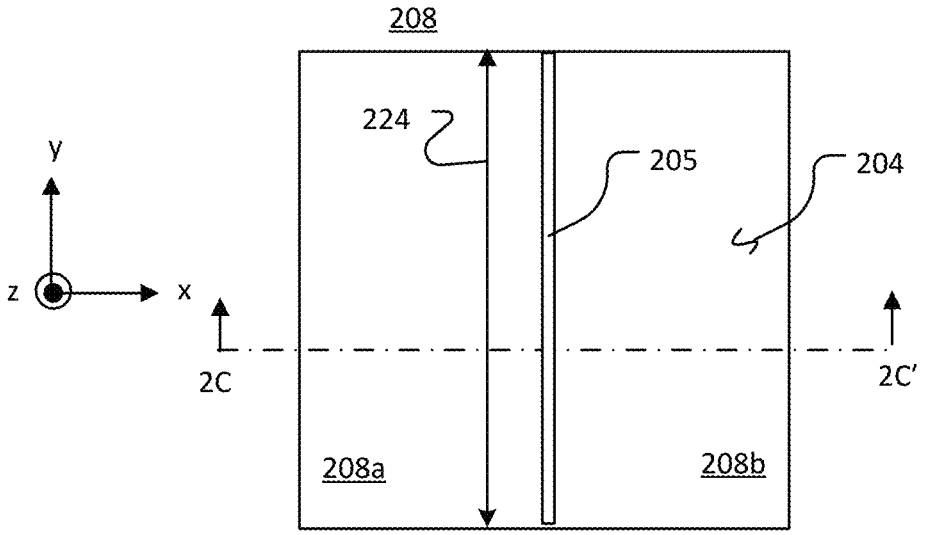
FIG. 2C is an example of a segment of moldable material.
Figure 2D:
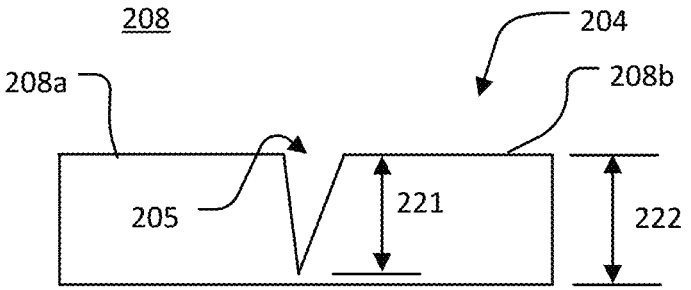
FIG. 2D is a side view of the segment of FIG. 2C.

FIGS. 2A and 2B are block diagrams of a first mold portion 210. FIG. 2C is a block diagram of a segment 208 formed using the first mold portion 210. FIG. 2D is a cross-sectional view of the segment 208.

The first mold portion 210 is an example of an implementation of the first mold portion 110. The first mold portion 210 may be part of a toy set such as the toy set 100. FIG. 2A shows the first mold portion 210 in the x-y plane. FIG. 2B is a side cross-sectional view of the first mold portion 210 in the x-z plane taken along line 2A-2A' of FIG. 2A.

The first mold portion 210 includes a first base portion 211, an indentation formation portion 212, and a cutting portion 214. The indentation formation portion 212 is shown with gray shading. The indentation formation portion 212 and the cutting portion 214 extend from a first side 213 of the first base portion 211 along the z direction. The base portion 211 generally extends in the x-y plane and may include flat surfaces.

Referring to FIG. 2B, the indentation formation portion 212 includes sides 215*a*, 215*b* that slant toward each other and meet at a tapered edge 216. Each side 215*a*, 215*b* forms an angle relative to the x-y plane. The angle at which each side 215*a*, 215*b* is oriented relative to the x-y plane may be the same or different. In the example of FIGS. 2A and 2B, the indentation formation portion 212 is a wedge, and the indentation formation portion 212 has a triangular cross-section in the x-z plane. In other implementations, the indentation formation portion 212 has a different cross-section in the x-z plane. For example, the sides 215*a*, 215*b* may be straight sides that are perpendicular to the first side 213 and the indentation formation portion 212 may include a rounded edge or a parabolic edge that extends from the straight sides 215*a*, 215*b*, or the indentation formation portion 212 may have a rectangular shape in the x-z plane. Furthermore, although the indentation formation portion 212 is shown as being straight along the y direction, in other implementations, the indentation formation portion 212 has an arcuate or curved path in the x-y plane and/or the y-z plane, or a non-straight path that is formed from a collection of connected linear segments.

In the example shown in FIGS. 2A and 2B, the indentation formation portion 212 is a single segment that has a rectangular shape in the x-y plane at the first side 213. However, other implementations are possible. For example, the indentation formation portion 212 may have a more complex shape in the x-y plane (such as the indentation formation portion 112 of FIG. 1 or the indentation formation portion 912 of FIG. 9A). Moreover, the first mold portion 210 may include a plurality of indentation formation portions, and the indentation formation portions are not necessarily identical to each other.

The cutting portion 214 surrounds the indentation formation portion 212 in the x-y plane. In the example of FIGS.

2A and 2B, the cutting portion 214 is at an outer perimeter of the first mold portion 210 in the x-y plane. In other implementations, the cutting portion 214 is within the outer perimeter of the first mold portion 210. The cutting portion 214 may be a plate-like structure that has straight walls that extend in the z direction (such as the example shown in FIGS. 2A and 2B). The cutting portion 214 may have other forms. For example, the cutting portion 214 may be a wedged structure.

The indentation formation portion 212 has an extent 221 in the z direction, and the cutting portion 214 has an extent 222 in the z direction. The indentation formation portion 212 has an extent 224 in the y direction. The extents 221 and 222 are relative to the first side 213. The extent 222 is greater than the extent 221. In other words, the cutting portion 214 extends farther from the first side 213 than the indentation formation portion 212 extends from the first side 213.

The indentation formation portion 212 is made from any material that is capable of making an indentation in the moldable material 102. The cutting portion 214 is made from any material that is capable of separating or dividing the moldable material 102. For example, the indentation formation portion 212 and the cutting portion 214 may be made from a molded plastic material or a metal material. The indentation formation portion 212 may be made from a material that is softer than the cutting portion 214. In some implementations, the indentation formation portion 212 and the cutting portion 214 are made from the same material or the same type of material.

In operational use, a side 204 of the moldable material 102 is placed on the first mold portion 210 and pressed toward the first side 213. For example, the moldable material 102 may be placed on top of the first mold portion 210 and rolled out or flattened with a rod or rolling pin like device. Referring also to FIG. 2C, because the extent 222 of the cutting portion 214 is greater than the extent 221 of the indentation formation portion 212, pressing the moldable material 102 toward the first side 213 causes the cutting portion 214 to pass through the moldable material 102 and the indentation formation portion 212 to form an indentation 205 on a side 204 of the moldable material 102. Further, the moldable material 102 may also fall outside of cutting portion 114 when pressed or rolled into first mold portion 210. The cutting portion 214 separates the segment 208 from the rest of the moldable material 102. The shape of the segment 208 is determined by the shape of the cutting portion 214. The indentation 205 does not pass through the moldable material 102, thus the side 204 of the segment 208 includes the indentation 205.

Figure 2E:
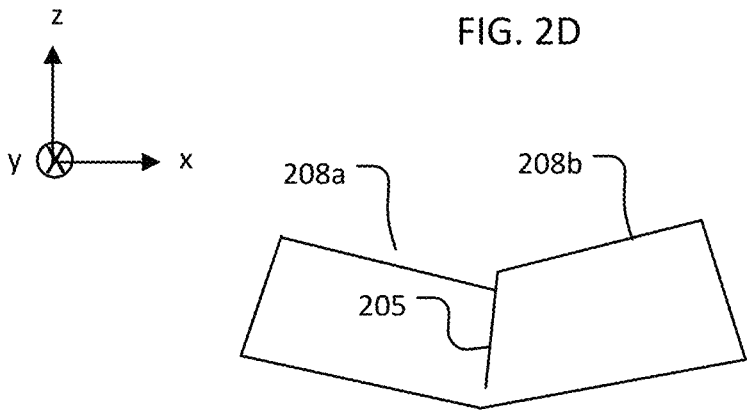
FIG. 2E is a side view of the segment of FIG. 2C folded.

After flattening or rolling the moldable material 102 into the first mold portion 210, the flattened segment 208 is removed from the first mold portion 210. FIG. 2C shows the side 204 of the segment 208 after the segment 208 and the first mold portion 210 are separated. FIG. 2D is a cross-sectional view of the segment 208 along the line 2C-2C' of FIG. 2C. The side 204 includes a sub-segment 208*a* and a sub-segment 208*b*. The sub-segments 208*a* and 208*b* are on opposite sides of the indentation 205. The segment 208 is folded at the indentation 205 by rotating the sub-segment 208*a* and/or the sub-segment 208*b* about the y axis until the sub-segments 208*a* and 208*b* make physical contact at the indentation 205. FIG. 2E shows the folded segment 208.

There are a range of possible dimensions for the extents 221, 222, and 224. The particular values of the extents 221, 222, and 224 depends on the desired form of the folded object or toy to be built. For example, if the first mold portion 210 is designed to make a roof structure for a relatively large toy house, the extent 224 may be 25 centimeters (cm). In another example, the first mold portion 210 is designed to make a roof structure for a relatively small toy house, and the extent 224 is 2.5 cm. The larger roof structure requires more of the moldable material than the smaller roof structure. Accordingly, the larger roof structure requires more support. The extent 222 determines the thickness of the moldable material used to form the roof structure. The extent 222 of a mold portion used to make the relatively large roof structure is greater than the extent 222 of a mold portion used to make the relatively small roof structure. Similarly, the extent of 221 of the indentation formation portion 212 is greater for a mold portion used to make a relatively large roof structure. For example, for a relatively small roof structure, the extent 222 may be, for example, about 8 millimeters (mm). The extent 221 may be, for example, about 6 mm. For a relatively large roof structure, the extent 222 may be, for example, about 8 cm, and the extent 221 may be, for example, about 6 cm.

Figure 3A:
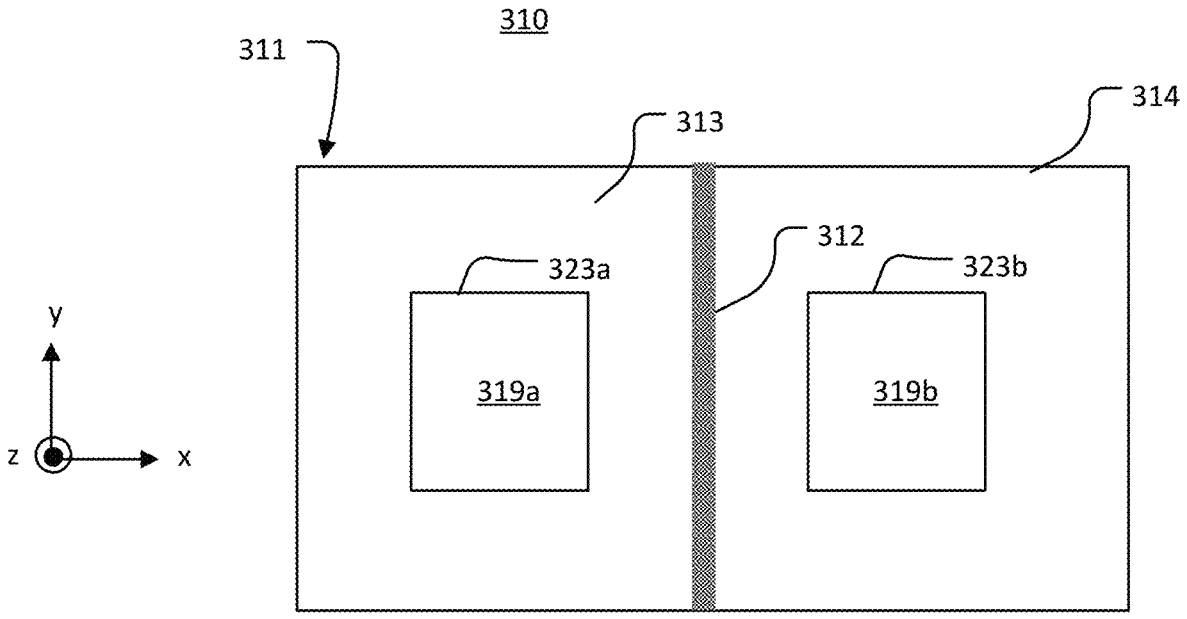
FIG. 3A is a block diagram of another example of a first mold portion.
Figure 3B:
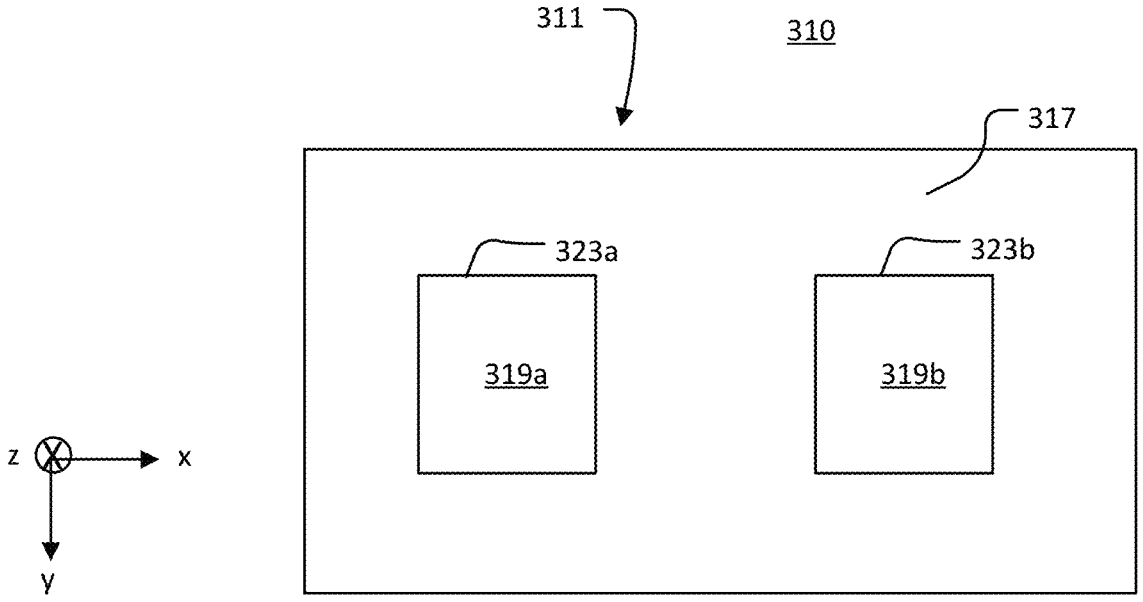
FIG. 3B is a block diagram of another example of a second mold portion.

Referring to FIGS. 3A and 3B, another example of a first mold portion 310 is shown. The first mold portion 310 includes a base portion 311 that has a first side 313 and a second side 317 opposite the first side. The base portion 311 extends generally in the x-y plane and may be a flat or plate-like structure.

FIG. 3A shows a plan view of the first side 313 of the first mold portion 310 in the x-y plane with the z direction extending out of the page. FIG. 3B shows a plan view of the second side 317 of the first mold portion 310. The first mold portion 310 includes an indentation formation portion 312 that extends from first the side 313 along the z direction. The indentation formation portion 312 also has a finite extent in the x and y directions. The indentation formation portion 312 is shown with gray shading. The first mold portion 310 also includes a cutting portion 314 that extends from the first side 313 along the z direction. The cutting portion 314 extends farther from the first side 313 along the z direction than the indentation formation portion 312.

Figure 9A:
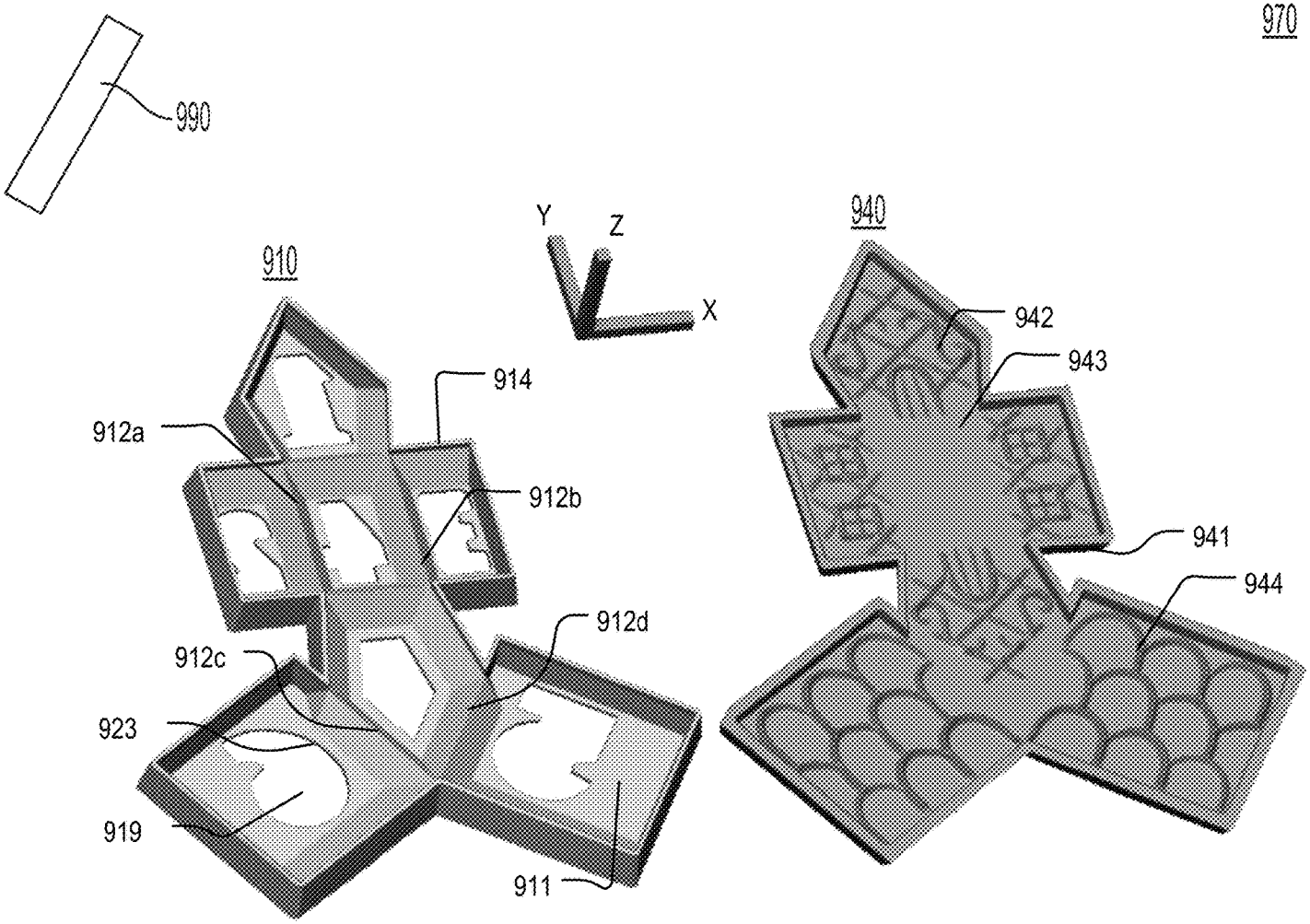
FIG. 9A is a perspective view of an example of a toy set.

The first mold portion 310 also includes openings 319*a*, 319*b* that pass through the base portion 311 in the z direction. The openings 319*a*, 319*b* are on opposite sides of the indentation formation portion 312. The openings 319*a*, 319*b* are defined by respective edges 323*a*, 323*b* of the base portion 311. In the example of FIGS. 3A and 3B, the edges 323*a*, 323*b* have a rectangular shape. However, other shapes are possible. For example, FIG. 9A shows a first mold portion 910 that includes edges 923 that are shaped like numbers.

Like the first mold portions 110 (FIG. 1) and 210 (FIGS. 2A and 2B), the moldable material 102 may be pressed into or flattened onto the first mold portion 310 to form indentations about which the moldable material 102 may be folded without separating. When the moldable material 102 is placed in the first mold portion 310, some of the moldable material 102 makes direct contact with a support (such as, for example, a table) upon which the second side 317 of the first mold portion 310 rests. By making direct contact with the support, the moldable material 102 helps to hold the first mold portion 310 in place while the user flattens the material 102 into the first mold portion 310. For example, if a rolling pin type device is used to roll the moldable material 102 in the x and/or y directions, some of the moldable material 102 passes though the openings 319*a*, 319*b* and adheres to the support temporarily. The adhesion between the material 102 and the support helps to prevent the first mold portion 310 from moving in the x-y plane, and therefore makes it easier for the user to flatten the material 102 into the first mold portion 310.

Figure 4A:
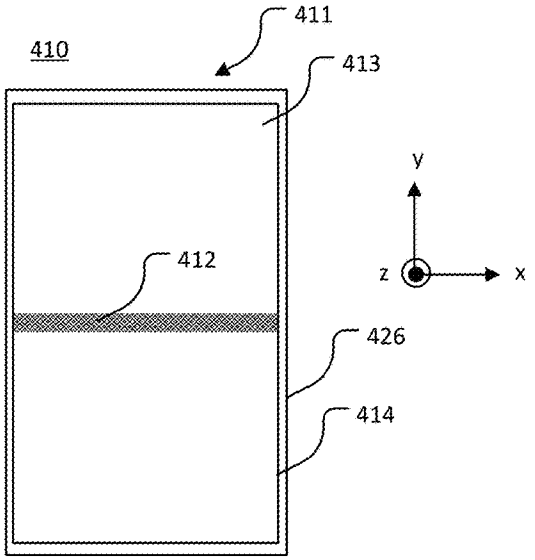
FIG. 4A is a block diagram of another example of a first mold portion.

Referring to FIG. 4A, a block diagram of another example of a first mold portion 410 is shown. The first mold portion 410 includes an indentation formation portion 412 (shown with gray shading) that extends in the z direction from a first side 413 of a base portion 411. The indentation formation portion 412 also extends in the x and y directions. The indentation formation portion 412 is similar to the indentation formation portions 112, 212, and 312 discussed above. The indentation formation portion 412 is used to form indentations (such as the indentations 105*a*-105*e* and 205) in the moldable material 102. The moldable material 102 is able to rotate about the formed indentations or fold at the formed indentations without separating. The extent of rotation that may occur depends on the size and shape of the indentation portion 412.

In the example of FIG. 4A, the base portion 411 has a rectangular shape and generally extends as a flat surface in the x-y plane. The base portion has an outer perimeter 426 that lies in the x-y plane and does not substantially extend in the z direction. The first mold portion 410 also includes a cutting portion 414. The cutting portion 414 extends from the first side 413 in the z direction and extends farther in the z direction than the indentation formation portion 412. The cutting portion 414 also has a rectangular shape. In the example shown, the cutting portion 414 is within the outer perimeter 426. Other implementations are possible. For example, the cutting portion 414 may be at the outer perimeter 426 such that the cutting portion 414 and the outer perimeter 426 spatially overlap. In other implementations, the cutting portion 414 and the outer perimeter 426 partially overlap such that only some of the cutting portion 414 is at the outer perimeter 426. Moreover, the cutting portion 414 may have a different shape than the outer perimeter 426. For example, the cutting portion 414 may have a shape of an animal or a fanciful object and the outer perimeter 426 may be a rectangle or vice versa.

Figure 4B:
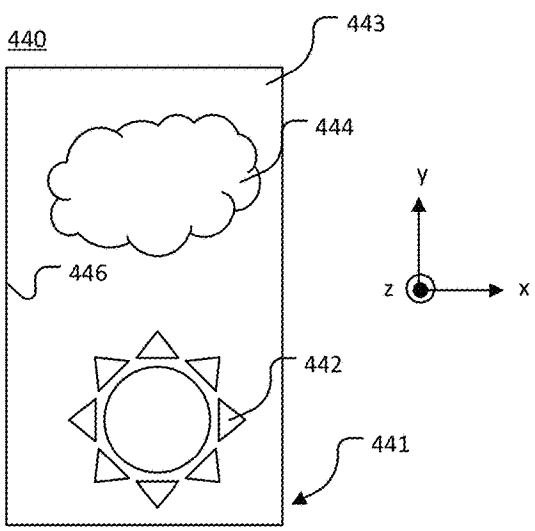
FIG. 4B is a block diagram of another example of a second mold portion.
Figure 4C:
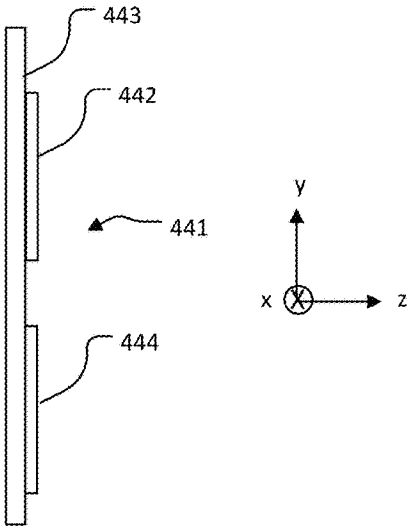
FIG. 4C is a side view of the second mold portion of FIG. 4B.

Referring also to FIGS. 4B and 4C, a second mold portion 440 is shown. FIG. 4B is a block diagram of the second mold portion 440 in the x-y plane. FIG. 4C is a block diagram of the second mold portion 440 in the y-z plane. The first mold portion 410 and the second mold portion 440 may be included together in a toy set.

The second mold portion 440 includes a second base portion 441. The second base portion 411 is a plate-like or flat structure that extends generally in the x-y plane. The second base portion 441 is made of any type of material that is sufficiently sturdy to support repeated manipulation and use by the user. The second base portion 441 may be a rigid material such as, for example, molded plastic or metal. The second base portion 441 may be a flat or plate-like structure. The second base portion 441 has an outer rectangular perimeter 446. The outer rectangular perimeter 446 is smaller than the cutting portion 414. Thus, in the example of FIGS. 4A-4C, the second base portion 441 is able to fit within the cutting portion 414. In other implementations, the outer rectangular perimeter 446 is larger than the cutting portion 414. In these implementations, the cutting portion 414 fits within the outer rectangular perimeter 446. In some implementations, the cutting portion 414 is the same shape and size as the perimeter 446. For example, when the first base portion 411 and the second base portion 412 are placed side-by-side in the orientation shown in FIGS. 4A and 4B, the cutting portion 414 and the perimeter 446 may have mirror symmetry about the y axis. Moreover, the cutting portion 414 and the perimeter 446 may have shapes other than a rectangle and may each have a different shape.

The second mold portion 440 includes design projections 442 and 444. The design projections 442 and 444 extend from a side 443 in the z direction. The design projections 442 and 444 are made from any rigid material that is able to make an imprint into the moldable material 102. For example, the design projections 442 and 444 may be made of a molded plastic or a metal. The design projections 442 and 444 may be, for example, strips of the rigid material that are arranged on a side 443 of the base portion in the shape of, for example, decorative patterns, objects, animals, or abstract designs. In the example of FIGS. 4B and 4C, the design projections 442 and 444 are outlines of a sun and a cloud, respectively.

Figure 5:
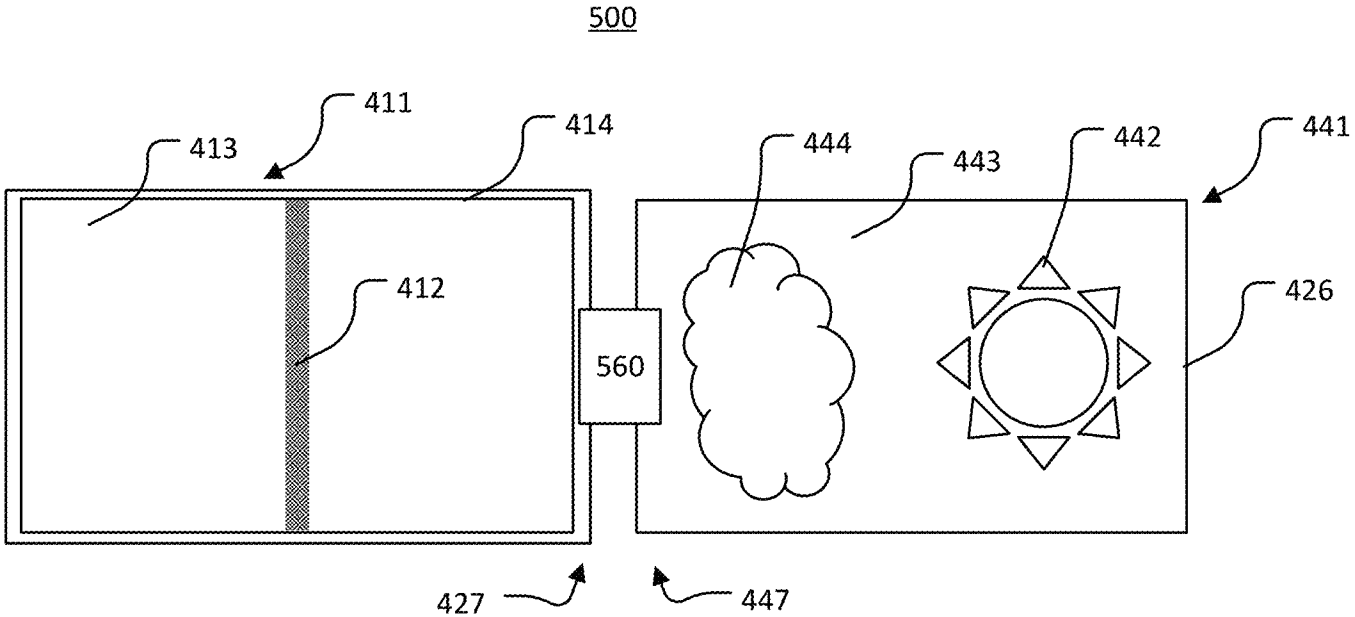
FIG. 5 is a block diagram of an example of a toy set.

Referring to FIG. 5, a block diagram of a toy set 500 is shown. The toy set 500 includes the first mold portion 410 and the second mold portion 440. In the toy set 500, the first mold portion 410 and the second mold portion 440 are connected to each other by a connection mechanism 560. The connection mechanism 560 is attached to the first mold portion 410 at an end 427 and to the second mold portion 440 at an end 447.

The connection mechanism 560 is any type of mechanism that allows the first mold portion 410 and the second mold portion 440 to move relative to each other such that the side 413 of the first mold portion 410 and the side 443 may be positioned to face each other. For example, the connection mechanism 560 may be a hinge that allows the first mold portion 410 and the second mold portion 440 to rotate relative to each other. In another example, the connection mechanism 560 may be a strap of a bendable material. In some implementations, the connection mechanism 560 is permanently connected to the ends 427 and 447. In other implementations, the connection mechanism 560 may be repeatedly connected and disconnected from the end 427 and/or the end 447.

Figure 6B:
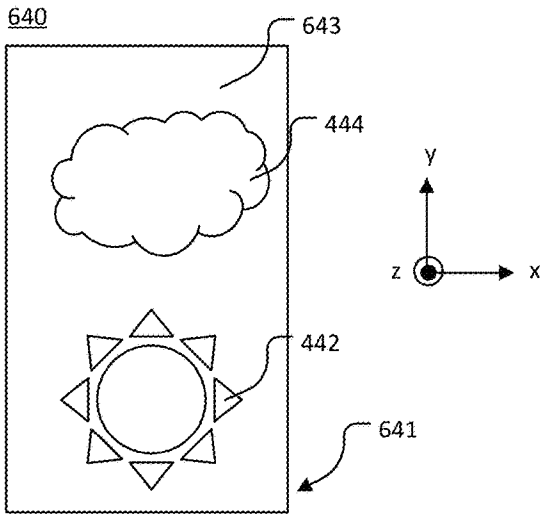
FIGS. 6B and 6C are block diagrams of another example of a second mold portion.
Figure 6C:
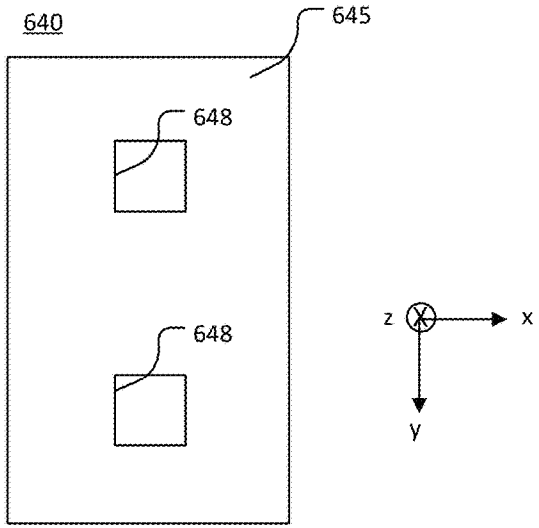
Figure 6A:
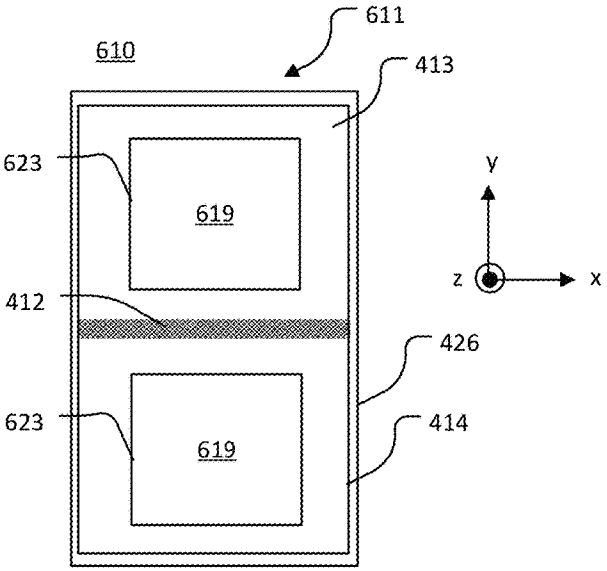
FIG. 6A is a block diagram of another example of a first mold portion.

Referring to FIG. 6A, a block diagram of a first mold portion 610 is shown. The first mold portion 610 is the same as the first mold portion 410 (FIG. 4A), except the first mold portion 610 includes a base portion 611 that defines openings 619. The openings 619 have a shape that is determined by edges 623. The openings 619 pass through the base portion 611.

Referring to FIGS. 6B and 6C, block diagrams of a second mold portion 640 in the x-y plane are shown. The first mold portion 610 and the second mold portion 640 may be included together in a toy set. The z direction extends out of the page in FIG. 6B and into the page in FIG. 6C. The second mold portion 640 is the same as the second mold portion 440 (FIGS. 4B and 4C), except the second mold portion 640 includes tabs 648.

The second mold portion 640 includes a base portion 641 that has a side 643 (FIG. 6B) and a side 645 (FIG. 6C) opposite the side 643. The design projections 442 and 444 extend from the side 643 in the z direction. The base portion 641 extends generally in the x-y plane. The base portion 641 may be made of, for example, a molded plastic or a metal material. The base portion 641 is rectangular and fits within the cutting portion 414 of the first mold portion 610. The tabs 648 extend in the −z direction from the side 645. The tabs 648 are made of any material that is able to press on the moldable material 102. The tabs 648 may be made from, for example, molded plastic or metal.

Figure 7:
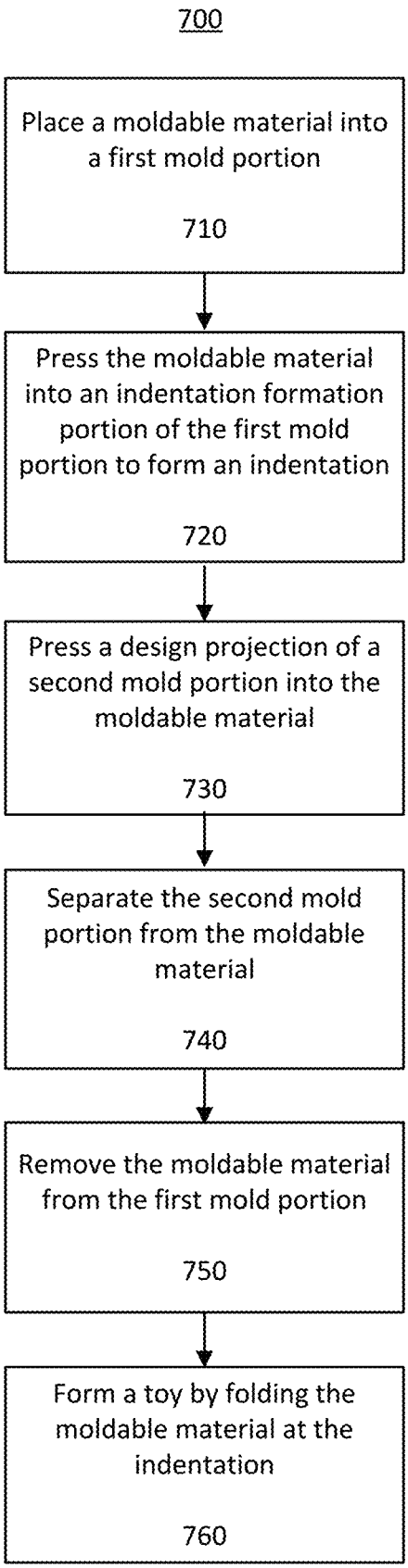
FIG. 7 is a flow chart of an example of a process for forming a folded object from moldable material.

FIG. 7 is a flow chart of a process 700. The process 700 is an example of a process for making a toy from the moldable material 102 (FIG. 1). The process 700 is discussed as being performed with the first mold portion 610 (FIG. 6A) and the second mold portion 640 (FIG. 6B). However, the process 700 may be performed with other mold portions. The process 700 is also discussed with respect to FIGS. 8A-8D.

The moldable material 102 is placed into the first mold portion 610 (710). For example, the first mold portion 610 may be placed on sturdy surface or support 870 (FIG. 8A) that is flat in the x-y plane. The moldable material 102 is placed onto the side 413 (FIG. 4A) after the first mold portion 610 is placed on the sturdy surface.

The moldable material 102 is pressed into the indentation formation portion 412 (720). For example, the moldable material 102 may be pressed into the indentation formation portion 412 by rolling the moldable material 102 in the x and y directions with a rolling pin or rod such that the moldable material 102 is flattened into a disk that extends in the x-y plane. In another example, a user may press on the moldable material 102 with their hands to flatten the moldable material 102 into a disk that covers the first mold portion 610. In yet another example, the moldable material 102 is a gel substance or other flowable substance that is capable of being shaped and holding a stable shape. In these implementations, the moldable material 102 may be completely or partially self-leveling and may be pressed into the indentation formation portion 412 without force being applied by the user. In these implementations, the moldable material 102 is pressed into the indentation formation portion 412 due to the physical properties of the moldable material 102 itself and the moldable material 102 spreads in the first mold portion 610 independently of force applied by the user.

Figure 8A:
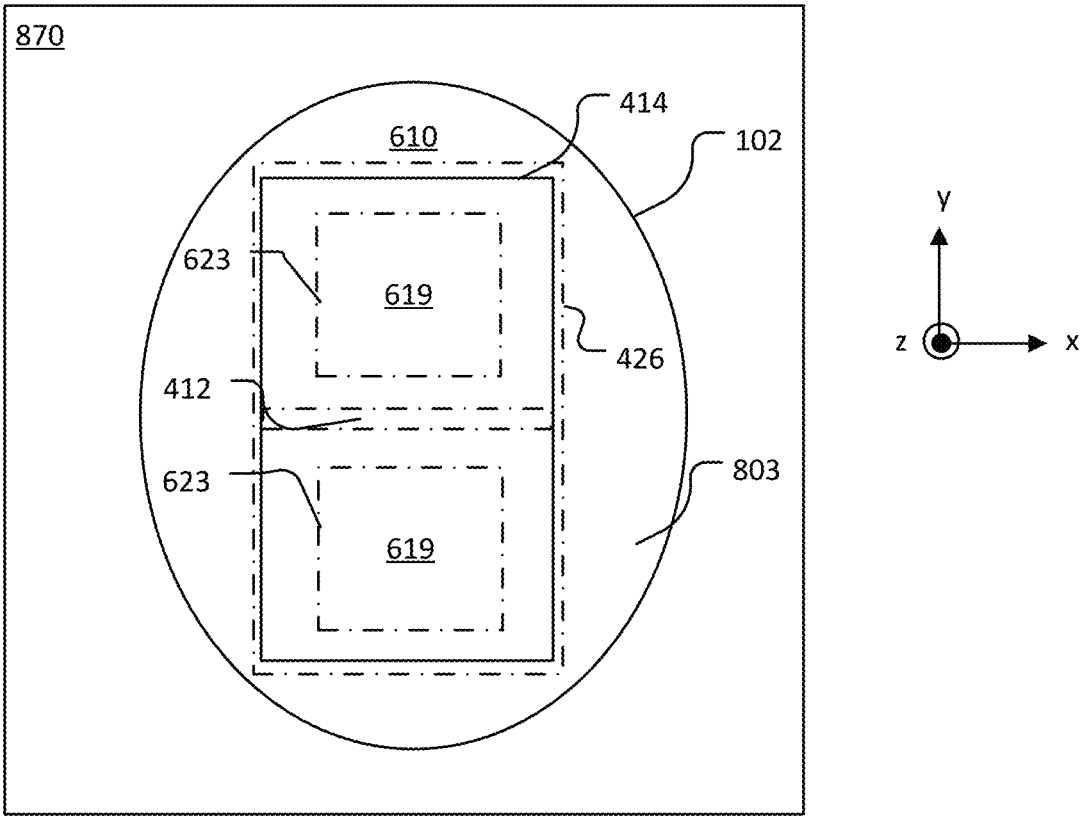
FIG. 8A shows a moldable material covering a first mold portion.
Figure 8B:
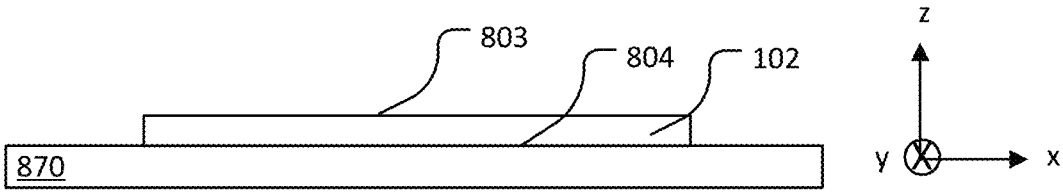
FIG. 8B shows the moldable material of FIG. 8A from the side.

Referring also to FIGS. 8A and 8B, an example of the moldable material 102 after being pressed into the first mold portion 610 is shown. In the example of FIGS. 8A and 8B, the first mold portion 610 rests on the support 870, which may be, for example, a top of a table. FIG. 8A shows the moldable material 102 in the x-y plane from the perspective of looking down onto the support 870 (with the z direction coming out of the page). FIG. 8B shows the moldable material 102 from the side in the x-z plane. The cutting portion 414 protrudes through the moldable material 102, but the other portions of the first mold portion 610 are under the moldable material 102. The moldable material 102 is opaque in this example. Thus, the portions other than the cutting portion 414 are between the support 870 and the moldable material 102 and are not visible from the vantage point of FIG. 8A. The elements that are under the moldable material 102 are shown with a dashed-dot line style in FIG. 8A.

The moldable material 102 has a side 803 that faces away from the support 870 and a side 804 (FIG. 8B) opposite the side 803. An indentation 805 (FIG. 8D) is formed on the side 804. The indentation 805 is formed due to the interaction between the indentation formation portion 412 and the moldable material 102. The indentation 805 does not pass through the moldable material 102. In other words, the indentation 805 may be considered to be a recess or slot in the moldable material 102 but the indentation formation portion 412 does not separate the moldable material 102 into separate pieces.

Referring again to FIG. 6B and FIG. 7, the design projections 442 and 444 are pressed into the side 803 to create imprints on the side 803 (730). The design projections 442 and 444 may be pressed into the side 803 by pressing the side 643 of the second mold portion 640 into the side 803 of the moldable material 102. The design projections 442 and 444 may be pressed into the side 803 while the moldable material 102 is in the first mold portion 610 or while the moldable material 102 is not in the first mold portion 610. In the example discussed with respect to FIG. 7, the design projections 442 and 444 are pressed into the side 803 while the moldable material 102 is in the first mold portion 610. Although the process 700 includes formation of the imprints, in other implementations, the imprints are not formed and the process does not include (730).

The second mold portion 640 is separated from the moldable material 102 (740). For example, the second mold portion 640 may be pulled off of the moldable material 102. The moldable material 102 is removed from the first mold portion 610 (750). The moldable material 102 may be removed from the first mold portion 610 by pushing on the side 804 in the z direction through the openings 619. The user may push on the side 804 with, for example, their hand or a solid object such as a rod (such as shown in FIG. 9A). The moldable material 102 may be removed from the first mold portion 610 in another manner. For example, the moldable material 102 may be removed by pulling on the side 803 or by turning the first portion mold 610 over and tapping the first mold portion 610 on the support 870 until the moldable material 102 is freed from the first mold portion 610.

Moreover, the tabs 648 also may be used to remove the moldable material 102 from the first mold portion 610. For example, the side 645 of the second mold portion 640 may be pressed against the side of the first mold portion 610 that is opposite the side 413 with the tabs 648 aligned with the openings 619. In this way, the tabs 648 may be used to push the moldable material 102 out of the first mold portion 210.

Figure 8C:
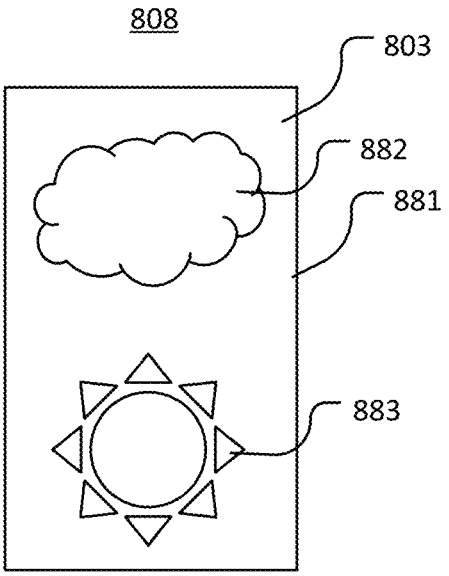
FIGS. 8C and 8D show a segment of moldable material.
Figure 8E:
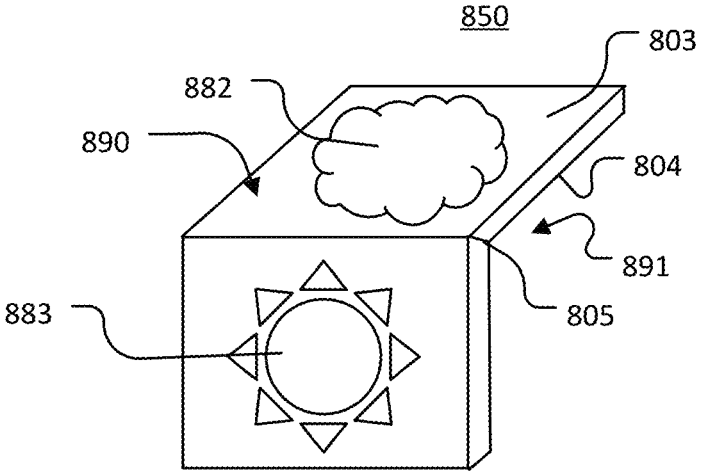
FIG. 8E shows the segment of FIGS. 8C and 8D folded.
Figure 8D:
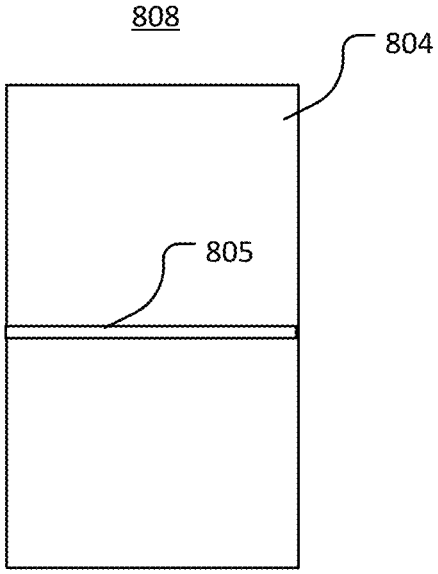

Referring also to FIGS. 8C and 8D, the moldable material 102 that is removed from the first mold portion 610 is a segment 808. The segment 808 is a continuous and single piece of the moldable material 102. The segment 808 is separated from the rest of the moldable material 102 because the cutting portion 414 passes through the moldable material 102. Thus, the segment 808 has an outer perimeter 881 that is the same shape as the cutting portion 414.

A toy 850 (FIG. 8E) is formed by folding the segment 808 at the indentation 805 (760). In the example shown in FIG. 8E, the segment 808 is folded about the indentation 805 such that imprints 882 and 883 formed by, respectively, design projections 444 and 442 are on an exterior 890 of the toy 850. In some implementations, the segment 808 may be folded around a support object to help provide the toy 850 with structural strength.

FIG. 9A is a perspective view of a toy set 900 that includes another example of a first mold portion 910 and another example of a second mold portion 940. The first mold portion 910 and the second mold portion 940 are resting on a support 970 that extends in the x-y plane. The support 970 may be, for example, a table. The first mold portion 910 includes a base portion 911, a plurality of indentation formation portions 912 that extend in the z direction from the base portion 911, and a cutting portion 914 at the outer perimeter of the first mold portion 910.

The indentation formation portion 912 is a collection of wedge shaped objects that are configured to form indentations in the moldable material 102. In the example of FIG. 9A, indentation portions 912*a*, 912*b*, 912*c*, 912*d* are labeled. The first mold portion 910 includes additional indentation portions that are not labeled. The indentations do not pass through the moldable material 102. The cutting portion 914 extends farther in the z direction than any of the indentation formation portions 912. The cutting portion 914 is configured to cut through the moldable material 102 to form a segment of the moldable material 102.

The indentation formation portions 912 form a plurality of design regions, each of which includes an opening 919. Only one of the openings 919 is labeled in FIG. 9A, but all of the openings 919 pass through the base portion 911. The shape of each opening 919 is determined by the shape of an edge 923 that defines the opening 919. In the example of FIG. 9A, six of the openings 919 are shaped as the numbers. In the example shown, the numbers are one, two, three, four, five, and six. The seventh opening is not shaped as a number. When the moldable material 102 is placed in the first mold portion 910, the shapes of the numbers are imparted onto the side of the material 102 that faces the base portion 911.

The second mold portion 940 includes a base portion 941 that extends in the x-y plane. The base portion 941 includes a plurality of design projections that extend in the z direction from a side 943 of the base portion 941. The design projections include a design projection 942 and a design projection 944. Like the design projections 442 and 444, the design projections of the second mold portion 940 are configured to make a decorative imprint on the moldable material 102.

Figure 9B:
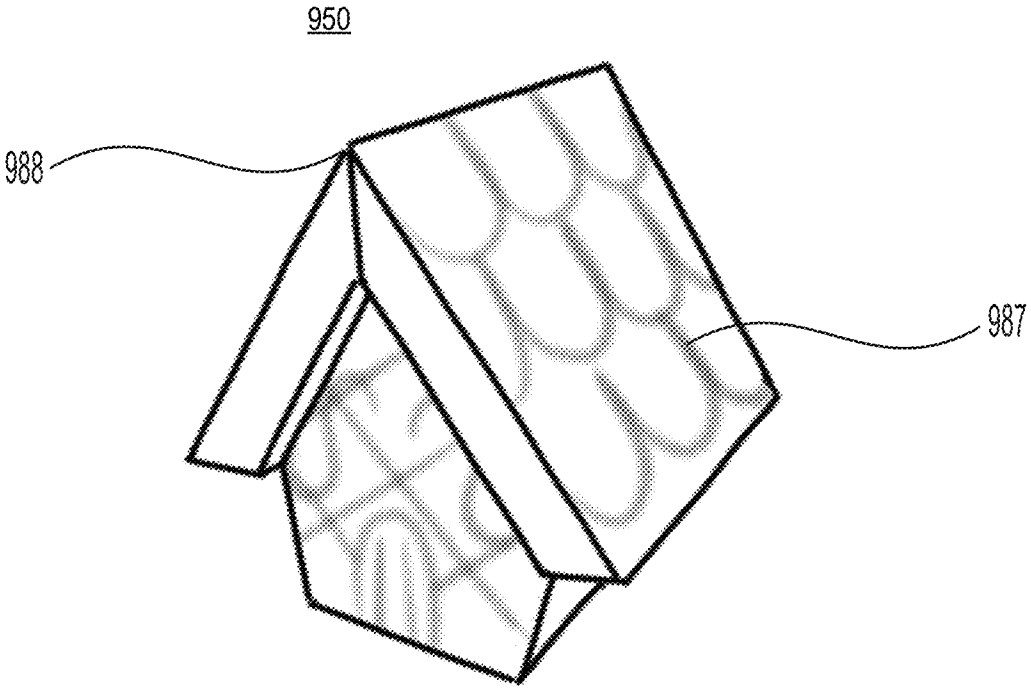
FIG. 9B is a perspective view of a folded segment of moldable material made with the toy set of FIG. 9A.

FIG. 9B shows a toy 950 that is made using the first mold portion 910 and the second mold portion 940. The toy 950 is a gingerbread house that is hollow. To form the toy 950, the moldable material 102 is placed in the first mold portion 910 and pressed against the indentation formation portion 912. Pressing the moldable material 102 into the first mold portion 910 causes the indentations to form on the side of the moldable material 102 that faces the indentation formation portion 912. The moldable material 102 does not separate at the indentations but the cutting portion 914 may separate the moldable material 102 into a segment such as the segment 808. The second mold portion 940 is pressed into the moldable material 102 to form imprints on a side of the moldable material 102 opposite to the side that has the indentations.

The moldable material 102 is removed from the first mold portion 910. For example, the moldable material 102 may be removed from the first mold portion 910 using a pressing device 990 (FIG. 9A). The pressing device 990 is any object that is capable of applying force to the moldable material 102. The pressing device 990 may be, for example, a rod or a dowel. To remove the moldable material 102 with the pressing device 990, the user holds the first mold portion 910 away from the support 970 and pushes the moldable material 102 through the openings 919 with the pressing device 990.

The moldable material 102 that is removed from the first mold portion 910 is a continuous single segment of the moldable material 102 that includes indentations and outlines of the edges 923 on one side and imprints on the other side. The user folds the segment at the indentations to form the toy 950 (FIG. 9A). The segment is folded such that imprints made by the design projections 942 and 944 are on the exterior of the toy 950. In the example shown, the user decorated the exterior of the toy 950 by tracing the imprints with icing.

The first mold portion 910 (FIG. 9A) is configured to indent and cut the moldable material into a segment that is folded into the toy house 950 (FIG. 9B). The various indentation formation portions 912 have different spatial properties. The spatial properties may be, for example, extent in the x direction, extent in the x-y plane, angle relative to the base portion 911, and edge shape. In the example of FIG. 9A, all of the indentation formation portions 912 have a wedged shaped edge.

The indentation formation portions 912*a* and 912*b* have the same spatial properties and are identical. Thus, the indentation formation portions 912*a* and 912*b* form identical indentations in the moldable material. The indentation formation portions 912*a* and 912*b* are used to make sub-segments in the moldable material that are folded into sidewalls and a base for the toy house. Having the same sized indentation ensures that the angles achieved between the walls and the base are the same once folded. The indentation formation portions 912*c* and 912*d* are used to make sub-segments that are roof panels 987 (FIG. 9B) for the toy house 950. The indentation formation portions 912*c* and 912*d* have the same spatial properties as each other to ensure that, when folded, the roof panels properly meet the sidewalls of the toy house 950. The cutting portion 914 (FIG. 9A) is angled relative to the base portion 911 to permit the relatively small angle 988 between the roof panels 987. A single mold portion (such as the first mold portion 910) may include a range of indentation formation portions and different cutting portions to enable the mold portion to form a segment that is foldable to create a structure with particular spatial features.

In some implementations, the toy set 900 includes instructions for building the toy 950 from the segment. The instructions may include a list of sequential steps that correspond to the outlines of the edges 923. For example, the instructions may include a step "1" that corresponds to the edge 923 that is shaped like the number 1, a step "2" that corresponds to edge 923 that is shaped like the number 2, and so on. Thus, in addition to providing additional stability and traction while pressing the moldable material 102 into the first mold portion 910, in this example, the openings 919 also help the user form the toy 950. The instructions may be included on a physical medium, such as paper or an electronic memory that is packaged with the toy set 900. In other examples, the instructions may be stored electronically at a location that is remote to the user and are available to the user through, for example, the Internet. In these examples, the toy set 500 also may include a summary set of instructions to guide the user in obtaining the complete instructions.

Other implementations are within the scope of the claims. For example, the first mold portion 610 and the second mold portion 640 may be connected by a connection mechanism such as the connection mechanism 560. The first mold portion 910 and the second mold portion 940 may be connected by a connection mechanism such as the connection mechanism 560. Any of the first mold portions 110, 210, 310, 410, 510, 610, 910 may be made without the respective cutting portion.

Figure 10:
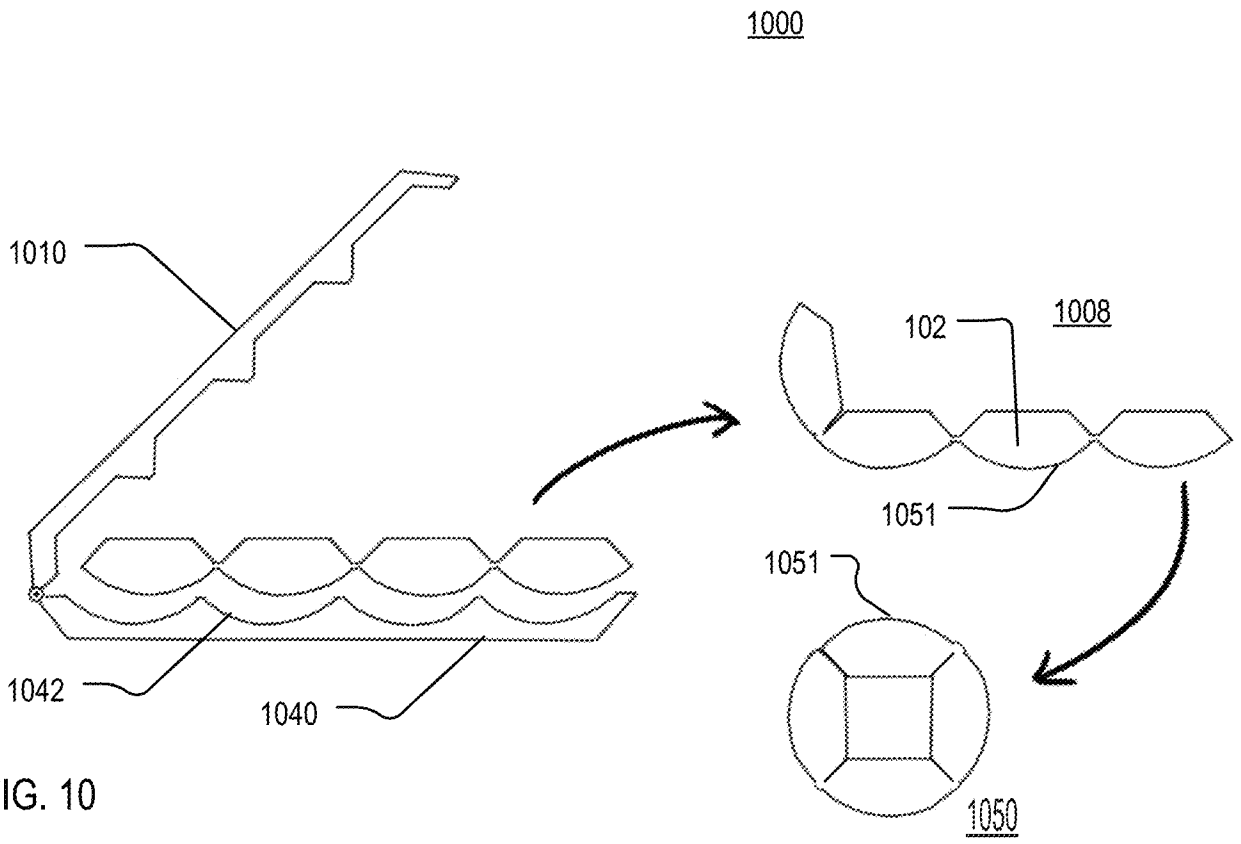
FIG. 10 is an illustration of another example of a toy set and a folded segment of moldable material.
Figure 11:
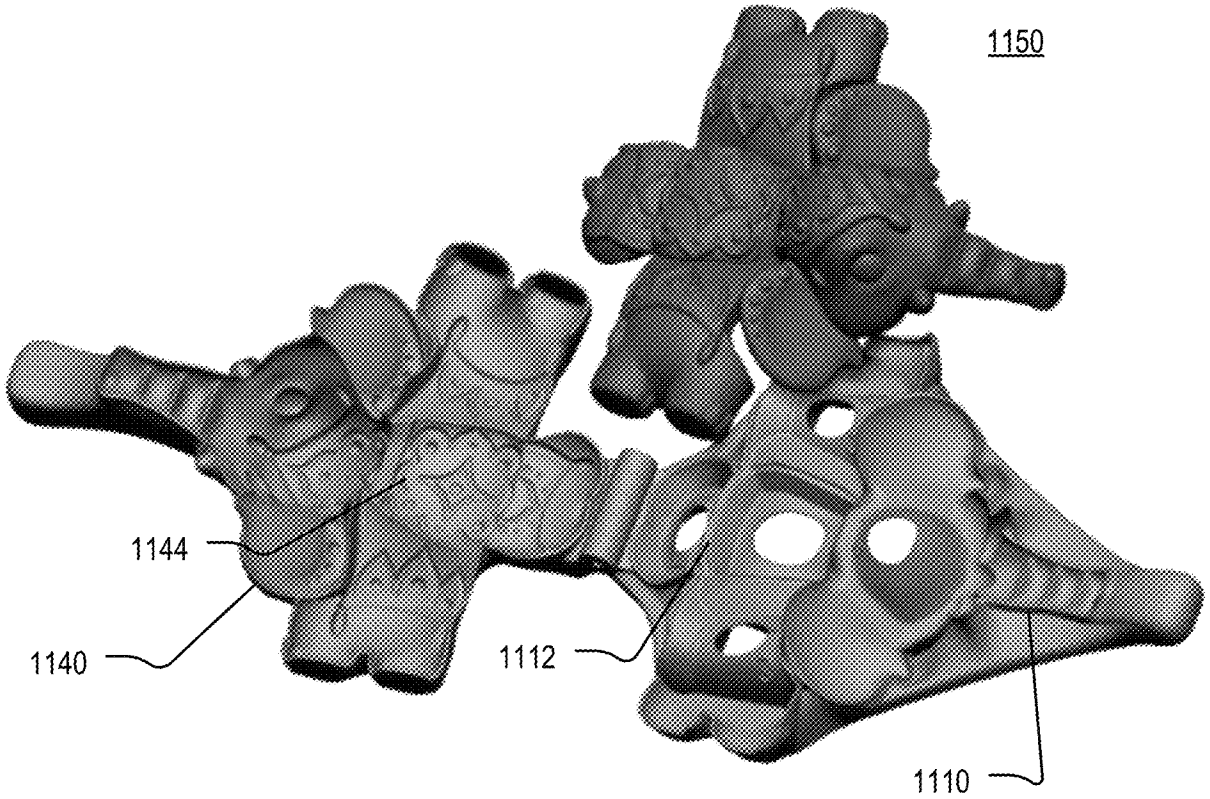
FIG. 11 is an illustration of another example of a toy set and a folded segment of moldable material.

Moreover, the example first mold portions 110, 210, 310, 410, 610, and 910 and the second mold portions 440, 640, and 940 discussed above are formed on generally flat base portions or bases. However, in other implementations, the first mold portion and/or the second mold portion have non-flat supports, bases, or regions from which indentation formation portions extent and/or are formed. FIGS. 10 and 11 show examples of toy sets that include mold portions with curved regions.

FIG. 10 shows a side view of toy set 1000 that includes a first mold portion 1010 and a second mold portion 1040. The second mold portion 1040 includes curved design projections 1042. The moldable material 102 is placed between the first mold portion 1010 and the second mold portion 1040 and a segment 1008 of the moldable material 102 is created. The curved design projections 1042 create a curved surface 1051 on the moldable material 102. When the segment 1008 of moldable material is folded about indentations formed by the first mold portion 1010, a rounded or spherical object 1050 is formed.

Moreover, the first mold portion and the second mold portion do not necessarily extend in a flat plane. FIG. 11 shows a perspective view of a toy set 1100 that includes a first mold portion 1110 and a second mold portion 1140. The first mold portion 1110 and the second mold portion 1140 have rounded surfaces that do not extend in a flat plane. The first mold portion 1110 includes curved indentation formation portions 1112 (only one of which is labeled). The second mold portion 1140 includes design projections 1144 that are formed on curved surfaces. An elephant object 1150 is formed by pressing the moldable material between the first mold portion 1110 and the second mold portion 1140.

Figure 12A:
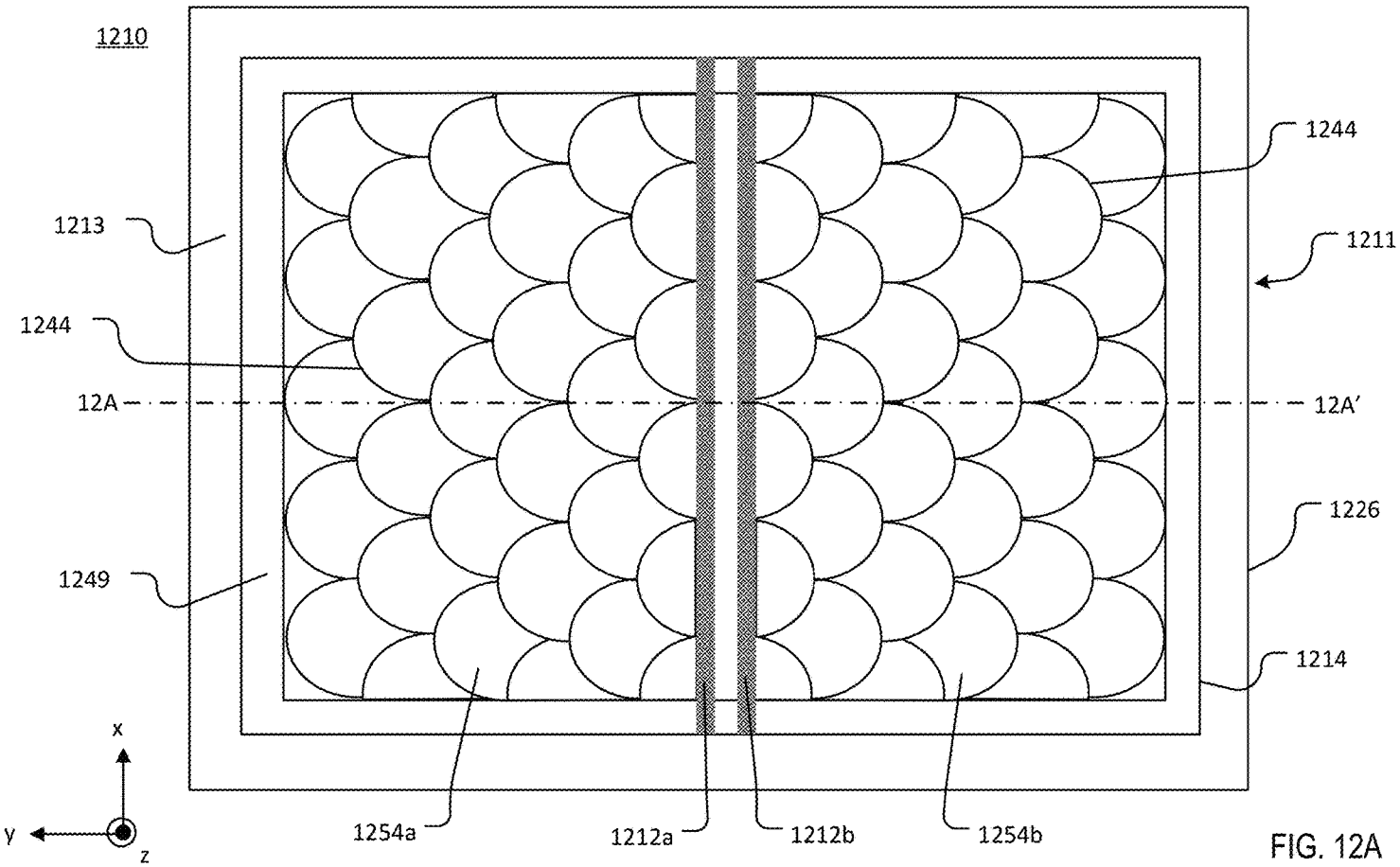
FIG. 12A is a block diagram of another example of a first mold portion.
Figure 12B:
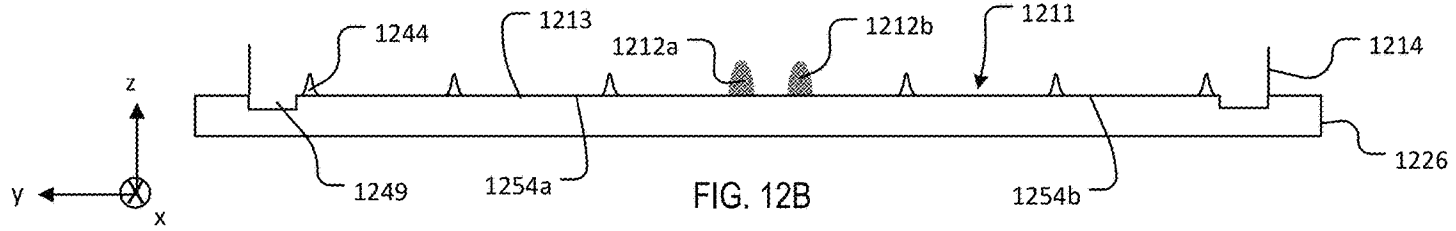
FIG. 12B is a profile view of the first mold portion of FIG. 12A.
Figure 12C:
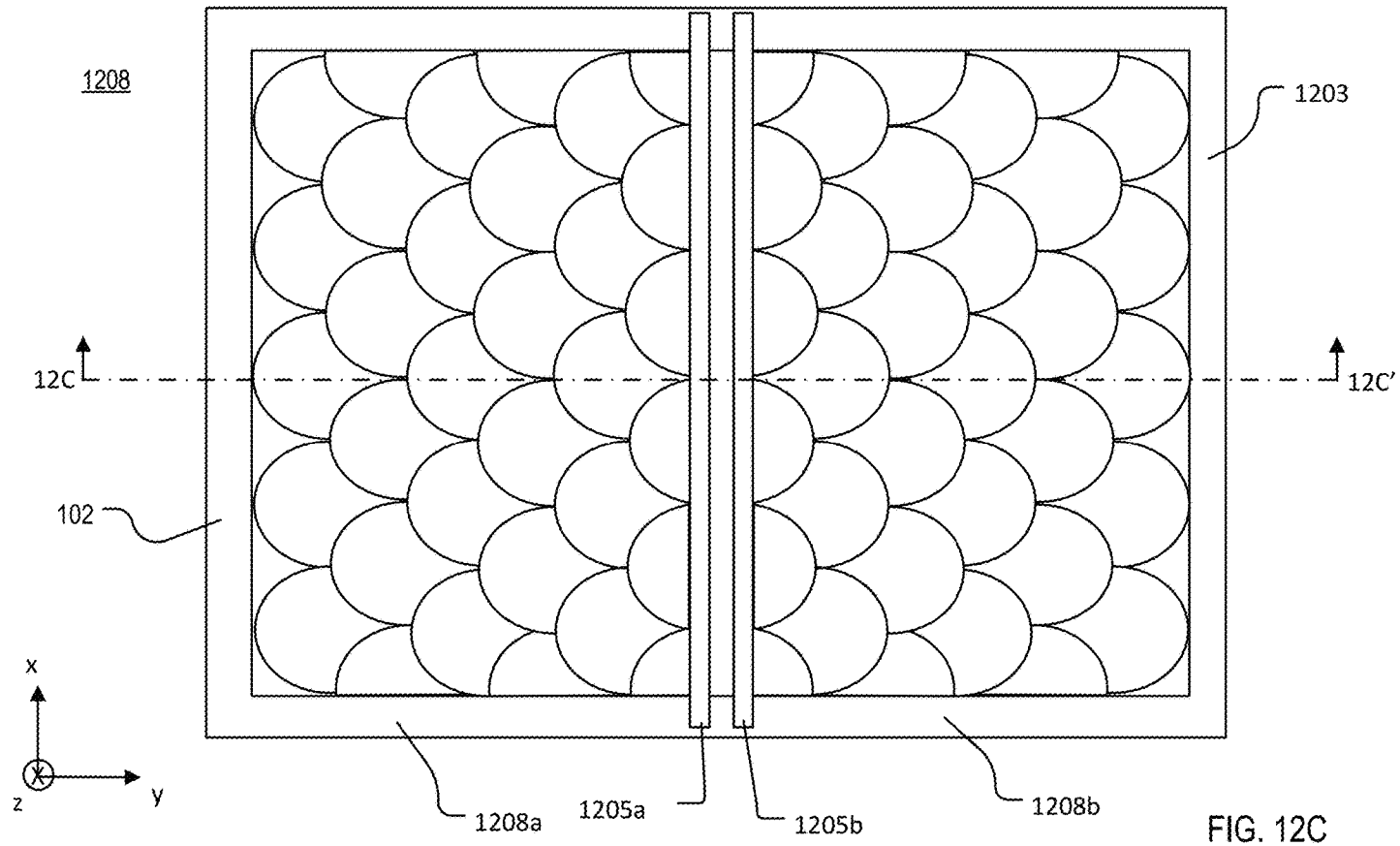
FIG. 12C is an example of a segment of moldable material.

Referring to FIGS. 12A and 12B, a first mold portion 1210 is shown. The first mold portion 1210 is another example of a mold portion for forming a toy from the moldable material 102. The first mold portion 1210 includes indentation formation portions 1212*a* and 1212*b*, which are used to provide fold points or indentations in the moldable material 102, and design projections 1244, which are used to decorate the moldable material 102. FIG. 12A is a block diagram of the first mold portion 1210 in the x-y plane. FIG. 12B is a profile of the first mold portion 1210 in the z direction taken along the line 12A-12A' of FIG. 12A. FIG. 12C shows a segment 1208 made using the first mold portion 1210.

The first mold portion 1210 includes indentation formation portions 1212*a* and 1212*b*. The indentation formation portions 1212*a* and 1212*b* extend in the z direction from a first side 1213 of a base portion 1211. The indentation formation portions 1212*a* and 1212*b* also extend in the x and y directions. Each of the formation portions 1212*a* and 1212*b* have a greater extent in the x direction than in the y direction. The indentation formation portions 1212*a* and 1212*b* are used to form indentations 1205*a* and 1205*b* (FIG. 12C) in the moldable material 102. In the example shown, each of the indentation formation portions 1212*a* and 1212*b* has a curved edge in the y-z plane. Other implementations are possible. For example, the edge of each indentation formation portion 1212*a* and 1212*b* may have a rectangular cross-section in the y-z plane.

The base portion 1211 has a rectangular shape in the x-y plane. The base portion 1211 has an outer perimeter 1226 that lies in the x-y plane. The base portion 1211 is made of any type of material that is sufficiently sturdy to support repeated manipulation and use by the user. The base portion 1211 may be a rigid material such as, for example, molded plastic or metal.

The first mold portion 1210 also includes a cutting portion 1214. The cutting portion 1214 extends from the first side 1213 in the z direction and extends farther in the z direction than the indentation formation portions 1212*a* and 1212*b*. The cutting portion 1214 also has a rectangular shape in the x-y plane. In the example shown, the cutting portion 1214 is within the outer perimeter 1226. Other implementations are possible. For example, the cutting portion 1214 may be at the outer perimeter 1226 such that the cutting portion 1214 and the outer perimeter 1226 spatially overlap. In other implementations, the cutting portion 1214 and the outer perimeter 1226 partially overlap such that only some of the cutting portion 1214 is at the outer perimeter 1226.

The first mold portion 1210 includes a first design region 1254*a* and a second design region 1254*b*. Each of the design regions 1254*a* and 1254*b* includes design projections 1244. For simplicity, only one design projection 1244 is labeled in each of the design regions 1254*a* and 1254*b*. The design projections 1244 extend from the first side 1213 in the z direction. The design projections 1244 have an extent in the z direction that is smaller than the extent of the indentation formation portions 1212*a* and 1212*b* in the z direction and is smaller than the extent of the cutting portion 1214 in the z direction. The design projections 1244 are made from any rigid material that is able to make an imprint into the moldable material 102. For example, the design projections 1244 may be made of a molded plastic or a metal. Like the design projections 442, 444, 942, 944, the design projections 1244 are configured to make a decorative imprint on the moldable material 102.

The base portion 1211 also has a recessed region 1249. The recessed region 1249 has a rectangular shape in the x-y plane. The recessed region 1249 surrounds a space that includes the first design region 1254*a* and the second design region 1254*b*.

Figure 12D:
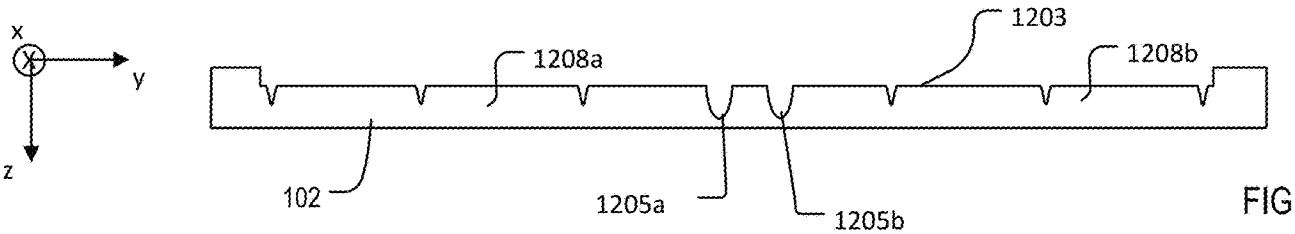
FIG. 12D is a cross-sectional view of the segment of FIG. 12C.
Figure 12E:
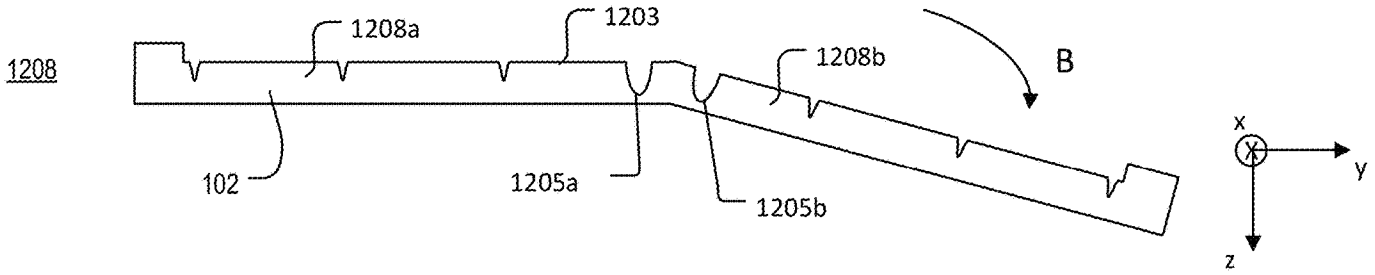
FIG. 12E is a cross-sectional view of the segment of FIG. 12C folded.
Figure 12F:
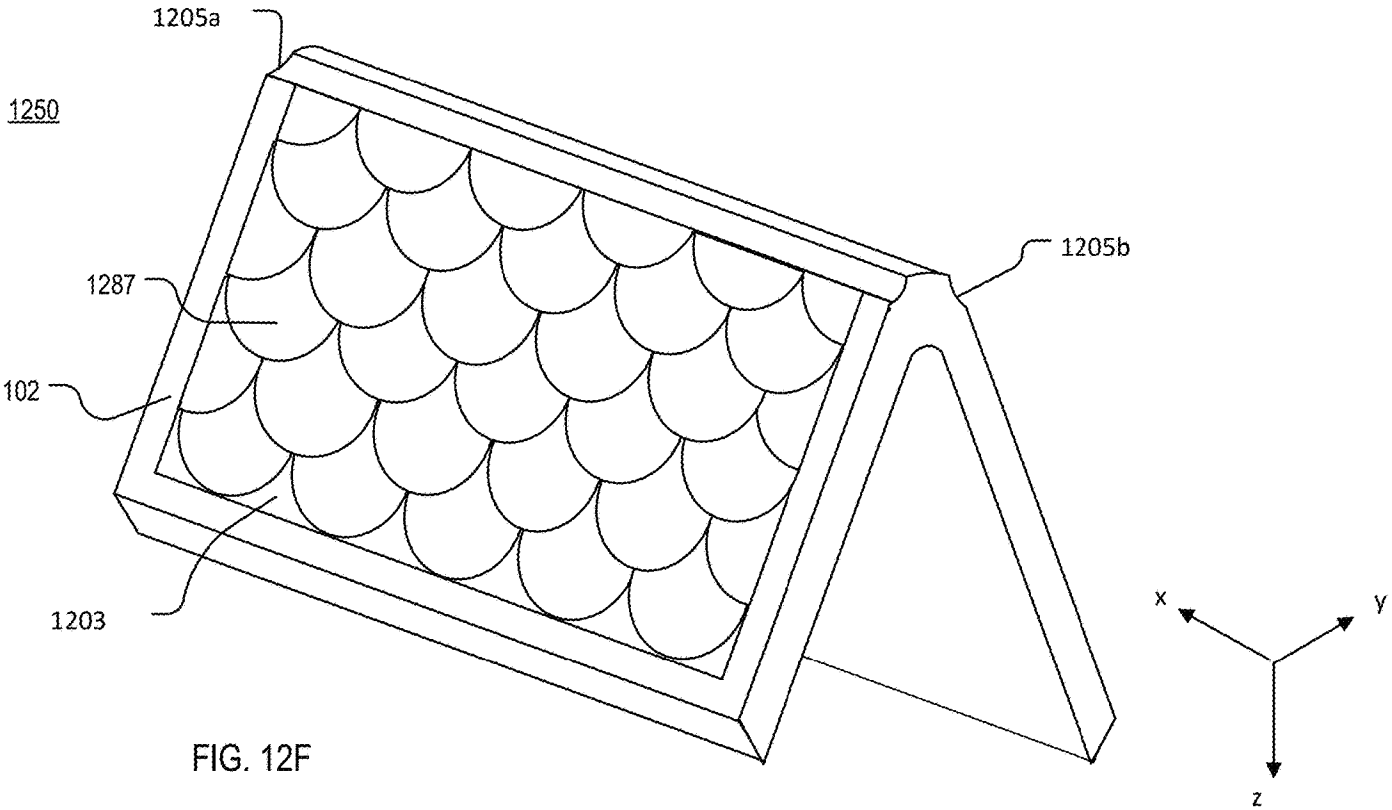
FIG. 12F is a perspective view of an example of a toy.

Referring also to FIGS. 12D-12F, the first mold portion 1210 is used to make a toy 1250. FIG. 12D shows a cross-section of the segment 1208 in the y-z plane taken along the line 12C-12C' of FIG. 12C. FIG. 12E shows the cross-section of the segment 108 as the segment 1208 is being folded into the toy 1250. FIG. 12F is a perspective view of the toy 1250.

The toy 1250 is a roof structure that may be used as the roof of a toy house. To form the toy 1250, the moldable material 102 is placed in the first side 1213 of the first mold portion 1210. The moldable material 102 is pressed against the indentation formation portions 1212*a* and 1212*b*, the design projections 1244, and into the recessed region 1249. For example, the moldable material 102 may be flattened into the first mold portion 1210 with a rod or by a user pressing on the moldable material 120 with their hand.

Pressing the moldable material 102 into the first mold portion 1210 causes the cutting portion 1214 to cut the moldable material 102 into the segment 1208 (FIG. 12C). Pressing the moldable material 102 into the first mold portion 1210 also presses the moldable material 102 into the indentation portions 1212*a* and 1212*b*, thereby forming respective indentations 1205*a* and 1205*b* on the segment 1208. The indentation formation portions 1212*a* and 1212*b* have an extent in the z direction that is less than the extent of the cutting portion 1214 in the z direction. Thus, the side 1203 of the segment 1208 is indented or scored by the indentation formation portions 1212*a* and 1212*b*, but the segment 1208 is not cut all the way through by the indentation formation portions 1212*a* and 1212*b*. In addition, the design projections 1244 forms imprints 1287 on the side 1203 of the segment 1208. The imprints 1287 have the same shape in the x-y plane as the design projections 1244 (FIG. 12A).

The segment 1208 is removed from the first mold portion 1210. For example, the segment 1208 may be removed from the first mold portion 1210 by pulling on one edge or corner of the segment 1208. The segment 1208 is a continuous single piece of the moldable material 102 that includes the indentations 1205*a* and 1205*b* and the imprints 1287 on the side 1203. The segment 1208 rotates or folds about the formed indentations 1205*a* and 1205*b* without separating. Specifically, sub-segments 1208*a* and 1208*b* are folded at the respective indentations 1205*a* and 1205*b*. The sub-segment 1208*b* is rotated along an arc B toward the sub-segment 1208*a*. The segment 1208*b* is folded such that imprints 1287 made by the design projection 1244 are on the exterior of the toy 1205.

Figure 13A:
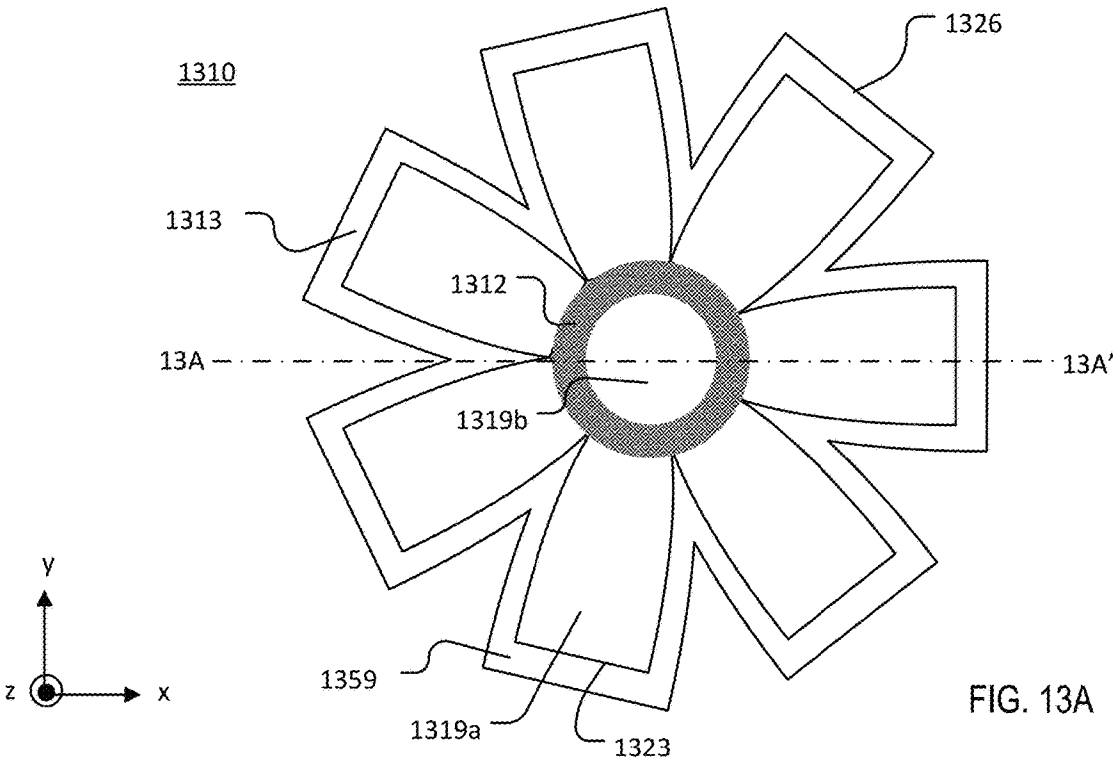
FIG. 13A is a block diagram of another example of a first mold portion.
Figure 13B:
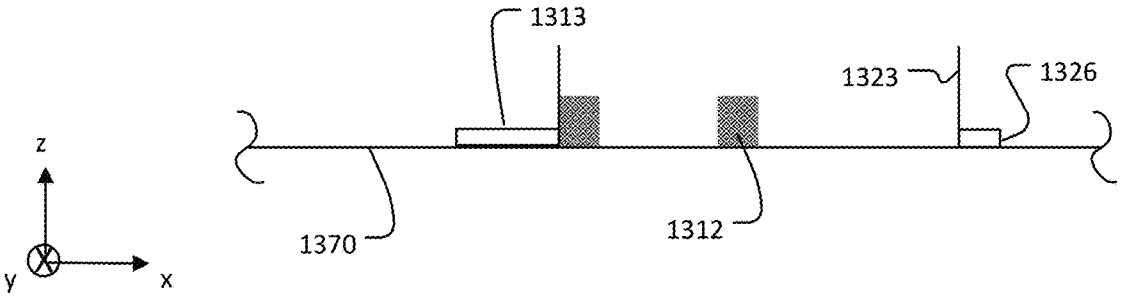
FIG. 13B is a profile view of the first mold portion of FIG. 13A.

Referring to FIGS. 13A and 13B, a first mold portion 1310 is shown. The first mold portion 1310 is another example of a mold portion that may be used to form a toy. FIG. 13A is a block diagram of the first mold portion 1310 in the x-y plane. FIG. 13B is a profile of the first mold portion 1310 in the z direction taken along the line 13A-13A' of FIG. 13A. The first mold portion 1310 is resting on a support 1370 that extends in the x-y plane. The support 1370 may be, for example, a table.

The first mold portion 1310 has a flower shape and generally extends in the x-y plane. The first mold portion 1310 includes an indentation formation portion 1312. The indentation formation portion 1312 is an annulus that extends in the z direction and defines a circular opening 1319*b*. Other implementations are possible. For example, the indentation formation portion 1312 may have a shape that is not circular such as a heptagon or a polygon.

The first mold portion 1310 also has an outer perimeter 1326 that lies in the x-y plane and a plurality of petal-shaped portions 1359 that extend radially outward from the indentation formation portion 1312. For simplicity, only one of the petal-shaped portions 1359 is labeled in FIG. 13A. Each petal-shaped portion 1359 includes a cutting edge 1323 that defines an opening 1319*a*. The cutting edge 1323 has a greater extent in the z direction than the indentation formation portion 1312. The first mold portion 1310 is made of any type of material that is sufficiently sturdy to support repeated manipulation and use by the user. The first mold portion 1310 may be a rigid material such as, for example, molded plastic or metal.

Figure 13C:
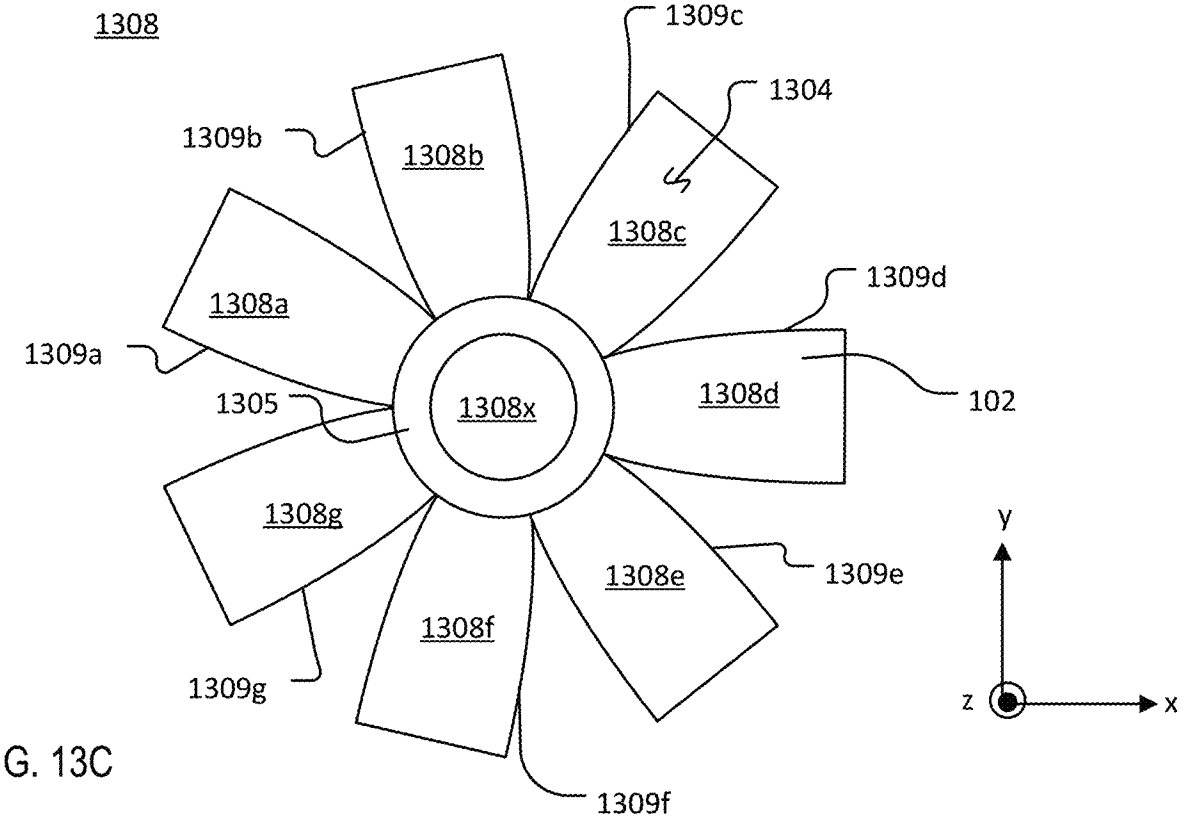
FIG. 13C is an example of a segment of moldable material.
Figure 13D:
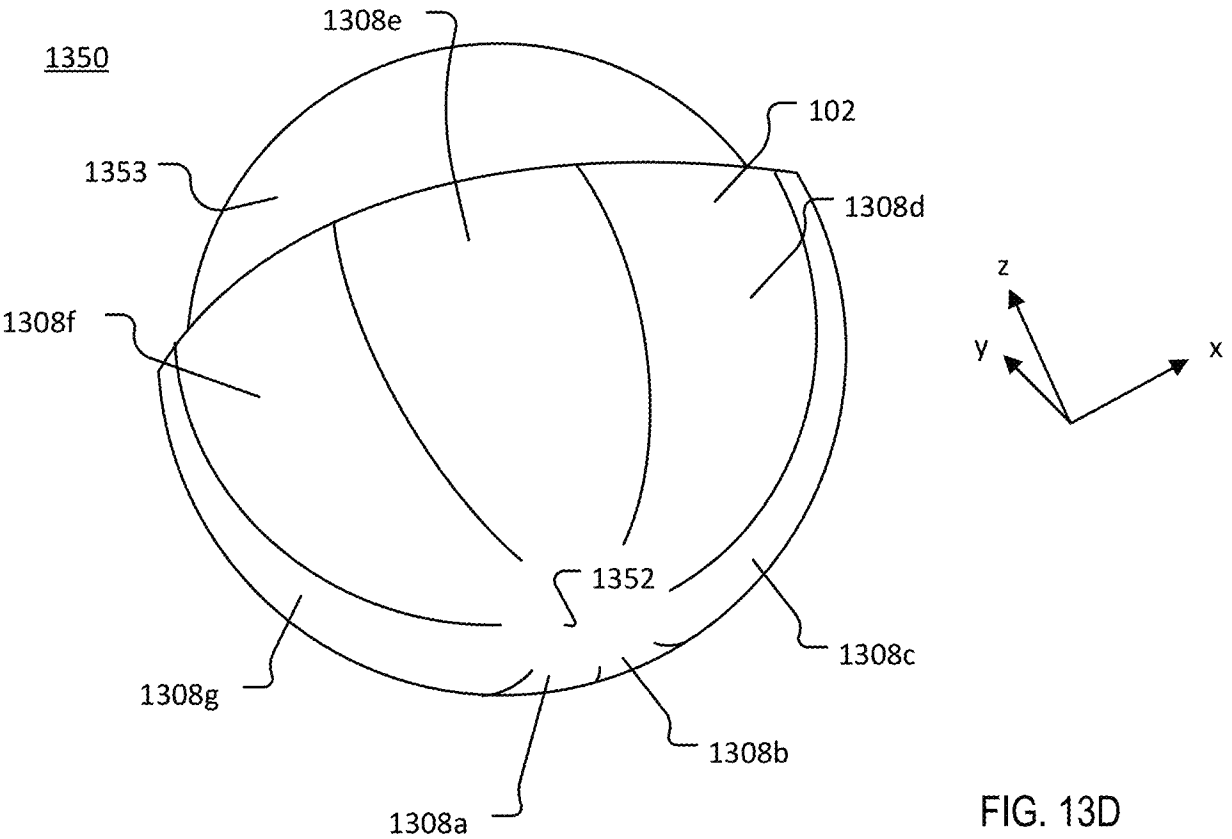
FIG. 13D is a perspective view of another example of a toy.

Referring also to FIGS. 13C and 13D, the first mold portion 1310 is used to make a toy 1350. FIG. 13C shows a flower-shaped segment 1308 made using the first mold portion 1310. FIG. 13D shows the toy 1350.

The moldable material 102 is placed in a first side 1313 of the first mold portion 1310. The moldable material 102 is pressed against the indentation formation portion 1312 and the cutting edge 1323. The cutting edge 1323 passes through the moldable material 102, thereby separating the moldable material 102 and forming the flower-shaped segment 1308. Pressing the moldable material 102 into the first mold portion 1310 also causes an indentation 1305 to form on a side 1304 of the segment 1308. The side 1304 is the side that faces the first mold portion 1310. The indentation formation portion 1312 does not pass through the segment 1308. The segment 1308 does not separate at the indentation 1305.

The segment 1308 is removed from the first mold portion 1310. For example, the segment 1308 may be removed from the first mold portion 1310 by pushing the segment 1308 through one or more of the openings 1319*a* and/or the opening 1319*b*. The flower-shaped segment 1308 includes a central region 1308*x* that is surrounded by the indentation 1305. The flower-shaped segment 1308 also includes petal regions 1308*a*-1308*g* that extend radially outward from the central region 1308*x*. Each petal region 1308*a*-1308*g* has a respective edge 1309*a*-1309*g*. The flower-shaped segment 1308 is a single piece of the moldable material 102.

To form the toy 1350, the user folds the segment 1308 at the indentation 1305 such that the petal regions 1308*a*-1308*g* extend about a support object 1353. The segment 1308 is folded such that a region 1352 that is on the side of the moldable material 102 opposite to the side 1304 (which is the side with the indentation 1305) is on the exterior of the toy 1350. The region 1352 does not have a visible indentation or fold line. The edges 1309*a*-1309*g* of any two adjacent ones of the petal regions 1308*a*-1308*g* may touch each other after the petal regions 1308*a*-1308*g* are folded onto the support object 1353.

Furthermore, other implementations and variations are within the scope of the present disclosure. For example, pressing the moldable material 102 into any of the first mold portions discussed above may include pressing the first mold portion into the moldable material. Moreover, the any of the second mold portions may include indentation formation portions in addition to or instead of design projections. Additionally, the moldable material 102 may be pressed into the design projections and/or other elements of any of the second mold portions discussed above. Although the example toy sets discussed above include a first mold portion or a first mold portion and a second mold portion, a toy set may include more than two mold portions. For example, a toy set may include three, four, or any number of mold portions. In some implementations, a toy set includes more than one mold portion that includes design projections, and each of the more than one mold portion includes a design projection with a different visual appearance such that the user may apply a variety of design projections to a foldable segment of moldable material.

What is claimed is:

1. A toy set comprising:

a first mold portion comprising:

a first base portion;

a plurality of indentation formation portions, each indentation formation portion extending upward from the first base portion, and each indentation formation portion comprises an edge;

a region that extends in a plane between at least two of the plurality of indentation formation portions, the region comprising an opening that passes through the first base portion; and a perimeter that extends upward from the first base portion and surrounds the plurality of indentation formation portions, wherein the first mold portion is configured to receive a moldable material;

each indentation formation portion is configured to form a first sub-segment, a second sub-segment, and an indentation between the first sub-segment and the second sub-segment in a first side of the moldable material;

each indentation formation portion is configured such that the formed indentation allows the moldable material to fold at the indentation without separating, and the perimeter extends farther from the first base portion than each of the plurality of indentation formation portions such that the perimeter is configured to separate a portion of the moldable material that extends past the perimeter from the rest of the moldable material.

2. The toy set of claim 1, further comprising a pressing device configured to apply pressure to the first side of the moldable material through any one of the openings.

3. The toy set of claim 1, further comprising a second mold portion, and wherein the second mold portion comprises:

a second base portion, and at least one design projection extending from the second base portion.

4. The toy set of claim 3, wherein the first mold portion comprises a plurality of openings that pass through the first base portion, the design projection is formed on a first side of the second base portion, tabs extend from a second side of the second base portion, and each tab is configured to fit into one of the plurality of openings in the first base portion.

5. The toy set of claim 3, wherein the first mold portion and the second mold portion are permanently connected to each other by a connection mechanism.

6. The toy set of claim 5, wherein the connection mechanism is configured to allow the first mold portion and the second mold portion to rotate relative to each other.

7. The toy set of claim 1, further comprising the moldable material.

8. The toy set of claim 3, wherein the perimeter of the first base portion of the first mold portion comprises a first perimeter having a first shape, the second base portion of the second mold portion comprises a second perimeter having a second shape, and the first and second shapes are substantially the same.

9. The toy set of claim 8, wherein the perimeter of the first mold portion fits within the perimeter of the second mold portion or the perimeter of the second mold portion fits within the perimeter of the first mold portion.

10. The toy set of claim 1, further comprising a support structure configured to hold the moldable material after the indentation is formed.

11. The toy set of claim 1, wherein at least one of the plurality of indentation formation portions comprise: a tapered edge, a first formation side that extends between the tapered edge and the base portion, and a second formation side that extends between the tapered edge and the base portion; and the first formation side, the second formation side, and the tapered edge form a triangle.

12. The toy set of claim 1, wherein at least one of the plurality of indentation formation portions comprises one or more spatial properties that are different from the same one or more spatial properties of at least one other of the plurality indentation formation portions.

13. The toy set of claim 1, wherein the first mold portion further comprises a design projection extending from the first side of the first base portion, and the design projection is configured to form an imprint in the first side of the moldable material.

14. The toy set of claim 13, wherein the moldable material is configured to fold at the formed indentations such that the imprint is on an exterior of a toy made using the moldable material.

15. The mold portion of claim 1, wherein the moldable material comprises one or more of PLAY-DOH, putty, clay, and a dough substance.

16. A method of forming a toy from a moldable material, the method comprising:

placing a first mold portion on a support with an indentation portion of the first mold portion extending in a direction that is away from the support;

placing the moldable material into a base portion of the first mold portion, the first mold portion comprising the indentation formation portion;

pressing the moldable material into the first mold portion and the indentation formation portion to thereby form a first sub-segment, a second sub-segment, and an indentation between the first sub-segment and the second sub-segment in a first side of the moldable material;

flattening a second side of the moldable material;

after flattening the second side of the molded material, pressing a second mold portion comprising at least one design projection into the second side of the moldable material to thereby imprint the at least one design projection onto the second side of the moldable material;

separating the second mold portion from the second side of the moldable material;

removing the moldable material from the first mold portion; and forming the toy by folding the moldable material at the indentation.

17. The method of claim 16, wherein the first mold portion comprises an opening defined in a first base portion, the opening extends along a direction that is orthogonal to a direction in which the indentation formation portion extends, and pressing the moldable material into the indentation formation portion farther forms an outline of the opening on the first side of the moldable material.

18. The method of claim 16, wherein separating the second mold portion from the second side of the moldable material comprises pulling the second mold portion away from the second side of the moldable material.

19. The method of claim 16, wherein pressing the second mold portion into the second side of the moldable material further comprises rotating the second mold portion about a connection point that connects the first mold portion and the second mold portion until the at least one design projection is pressed into the second side of the flattened moldable material in the first mold portion.

20. The method of claim 19, wherein removing the moldable material from the first mold portion further comprises rotating the second mold portion about the connection point until tabs on the second mold portion press on the first side of the flattened moldable material though one or more openings in the first mold portion.

21. The method of claim 16, wherein forming the toy by folding the moldable material at the indentation comprises folding the moldable material over a support structure.

22. The method of claim 16, wherein forming the toy by folding the moldable material at the indentation comprises folding the moldable material into an object that has an open region.

23. The method of claim 22, wherein the open region is enclosed by the moldable material such that the object is hollow.

24. The method of claim 16, wherein pressing the moldable material into the first mold portion forms more than one indentation in the first side of the moldable material; and forming the toy by folding the moldable material comprises folding the moldable material at more than one indentation to thereby form a hollow object.

25. The method of claim 16, wherein forming the toy by folding the moldable material at the indentation comprises folding the moldable material into a hollow object that has an open region surrounded by moldable material and the imprint of the one or more design projections faces away from the open region.

26. The toy set of claim 16, wherein the moldable material is removed from the first mold portion before pressing the second mold portion comprising at least one design projection into the second side of the moldable material.

27. The toy set of claim 16, wherein the moldable material is removed from the first mold portion after pressing the second mold portion comprising at least one design projection into the second side of the moldable material.

28. A toy set comprising:

a first mold portion comprising:

a first base portion comprising one or more openings that pass through the first base portion;

a plurality of indentation formation portions extending from the first base portion, each of the plurality of indentation formation portions comprising an edge; and a region that extends in a plane between at least two of the plurality of indentation formation portions;

a second mold portion comprising:

a second base portion, and at least one design projection extending from the second base portion; and a pressing device configured to apply pressure to the first side of the moldable material through any one of the openings, wherein the first mold portion is configured to receive a moldable material, each of the plurality of edges is configured to form an indentation in a first side of the moldable material, each of the plurality of indentations is configured to allow the moldable material to fold at the indentation without separating, and each of the at least one design projections is configured to form an imprint in a second side of the moldable material while the moldable material is received in the first mold portion.

29. The toy set of claim 28, wherein the first mold portion and the second mechanism are connected to each other by a connection mechanism, and the connection mechanism is configured to allow the first mold portion and the second mold portion to rotate relative to each other.

30. The toy set of claim 28, wherein one of the one or more openings forms at least part of the region that extends in the plane.

31. A mold portion for a toy, the mold portion comprising:

a planar base portion comprising a perimeter that surrounds a first side of the planar base portion, the first side of the planar base portion being configured to receive a moldable and imprintable material;

a plurality of indentation formation portions that extend from a first side of the planar base portion along a first direction, each of the indentation formation portions configured to form an indentation in the moldable material received in the first side of the planar base portion;

a plurality of design projections that extend from the first side of the planar base portion along the first direction, each of the design projections configured to form an imprint on the moldable material received in the first side of the planar base portion; and a cutting portion that extends from the first side of the planar base portion, the cutting portion being at or inside the perimeter, wherein the cutting portion is configured to cut through the moldable material received in the first side of the planar base portion, and the indentations are configured such that the moldable material folds at each of the indentations without separating.

32. A toy set comprising:

a first mold portion comprising:

a first base portion comprising at least one opening that passes through the first base portion;

a plurality of indentation formation portions, each indentation formation portion extending upward from the first base portion, and each indentation formation portion comprises an edge; and a region that extends in a plane between at least two of the plurality of indentation formation portions, wherein the first mold portion is configured to receive a moldable material;

each indentation formation portion is configured to form a first sub-segment, a second sub-segment, and an indentation between the first sub-segment and the second sub-segment in a first side of the moldable material; and each indentation formation portion is configured such that the formed indentation allows the moldable material to fold at the indentation without separating; and the toy set further comprises:

a pressing device configured to apply pressure to the first side of the moldable material through any one of the openings.

33. The toy set of claim 32, further comprising a second mold portion, and wherein the second mold portion comprises a second base portion.

34. The toy set of claim 33, wherein the second mold portion further comprises at least one design projection extending from the second base portion.

35. The toy set of claim 34, wherein the first mold portion and the second mechanism are connected to each other by a connection mechanism, and the connection mechanism is configured to allow the first mold portion and the second mold portion to rotate relative to each other.

36. The toy set of claim 32, wherein the opening that passes through the first base portion is in the flat region.

37. The toy set of claim 32, wherein one or more of the at least one openings passes through the region that extends in the plane.

38. A toy set comprising:

a first mold portion configured to receive a moldable material, the first mold portion comprising:

an indentation formation portion that extends upward to an edge, wherein the indentation formation portion is configured to form a first sub-segment, a second sub-segment, and an indentation between the first sub-segment and the second sub-segment in a first side of the moldable material; and the indentation formation portion is configured such that the formed indentation allows the moldable material to fold at the indentation without separating;

a perimeter that extends upward farther than the indentation formation portion such that the perimeter is configured to separate a portion of the moldable material that extends past the perimeter from the rest of the moldable material; and at least two open regions that each pass through the first mold portion, wherein a first one of the open regions is between a first side of the indentation formation portion and the perimeter, and a second one of the open regions is between a second side of the indentation formation portion and the perimeter.

39. The toy set of claim 38, further comprising:

a second mold portion comprising at least one design projection extending from the second base portion; and a pressing device configured to apply pressure to the first side of the moldable material through any of the at least two open regions.

40. The toy set of claim 38, wherein the first side of the indentation formation portion is opposite to the second side of the indentation formation portion.

* * * * *